United States Patent [19]

Regamey

[11] 4,177,767

[45] Dec. 11, 1979

[54] METHOD AND DEVICE FOR FEEDING A SYSTEM OF GENERATION AND DISTRIBUTION OF VAPOR CONDENSABLE INTO MAKE-UP LIQUID

[76] Inventor: Pierre E. Regamey, 35 Le Calabert, Ecully, France, 69130

[21] Appl. No.: 741,339

[22] Filed: Nov. 12, 1976

[30] Foreign Application Priority Data

| | | | |
|---|---|---|---|
| Nov. 13, 1975 | [FR] | France | 75 34705 |
| Sep. 13, 1976 | [FR] | France | 76 27510 |
| Sep. 13, 1976 | [FR] | France | 76 27511 |

[51] Int. Cl.[2] ..... F22D 5/30

[52] U.S. Cl. ..... 122/456; 122/1 R

[58] Field of Search ..... 122/1 R, 451 R, 456; 237/12.1, 13; 60/648

[56] References Cited

U.S. PATENT DOCUMENTS

| | | | |
|---|---|---|---|
| 894,897 | 8/1908 | Osborne | 237/12.1 |
| 977,841 | 12/1910 | Rollins | 122/456 |
| 3,116,876 | 1/1964 | Palm | 122/456 |

*Primary Examiner*—Kenneth W. Sprague

*Attorney, Agent, or Firm*—Silverman, Cass & Singer, Ltd.

[57] ABSTRACT

A closed-loop, steam generating and distributing system with uniform fluid temperature and pressure everywhere and devoid of any steam-trap or like phase separator, comprising a boiler, a receiver collecting condensates through gravity feed, a pump drawing condensates from said receiver and forcing them back into said boiler, a water make-up tank connected through a feed pipe-line and a feed pump to the bottom of said receiver, and a condensate bleed duct leading from the discharge side of the condensate pump to the top of said receiver through a restriction.

42 Claims, 20 Drawing Figures

METHOD AND DEVICE FOR FEEDING A SYSTEM OF GENERATION AND DISTRIBUTION OF VAPOR CONDENSABLE INTO MAKE-UP LIQUID

The present invention relates to improvements in a device for feeding a system of generation and distribution of vapour condensable into make-up liquid.

The invention applies more specially to a method of feeding with expendable or utilizable vaporizable liquid to be renewed periodically at least one condensable vapour generator with at least one evaporating boiler of a system of production, distribution and utilization of condensable vapour through a closed circuit containing fluid at least most part of which is binary comprising two faces, viz. a gaseous phase (vapour) and a liquid phase (condensate) and presenting in particular a temperature and a pressure at least approximately constant or substantially invariable everywhere, i.e. identically the same at all points of the whole circuit, between the point of supply of vapour at the pressure of utilization and the point of delivery of the condensates with recovery of at least part of the condensates discharged from the said system by directed, preferably substantially dry and, at least for the most part thereof, generally free or natural gravitational return flow. This method consists in replenishing each boiler from at least two make-up liquid supply sources used simultaneously or separately and constituted respectively, on the one hand, by at least one external reserve of feed liquid providing a possibly automatically controlled supply flow rate depending on the measured or detected present variation of the liquid level in each boiler within a defined range of controlled values between two limits, viz. an upper or feed shut-down limit and a lower or maximum feed flow-rate limit, and, on the other hand, by the said recovered condensates which are thereafter reintroduced directly into each boiler by forced or artificially accelerated circulation.

This method is characterized in that the said direct reintroduction of the condensates is either free or continuous as the admission of the recovered condensates proceeds, and depends only on their actually detected physical presence, or is controlled and interlocked in follow-up relationship with the said level and/or with a finite present amount of condensates collected or existing upstream.

The discharged condensates may be collected and accumulated at least temporarily into at least one main storage reserve forming one of the aforesaid make-up liquid sources, and then reintroduced through mechanical impulsion with automatic control of the flow rate of admission of the said make-up liquid (composed of at least one or of the mixture of its two constituents) to each boiler, the said automatic control being, for example, either of the floating on-off type or of the progressive or modulating action type interlocked in follow-up relationship with the instantaneous level or the present amount of liquid in the said boiler.

The invention also applies to the carrying out of the aforesaid method in an aforesaid system, comprising: at least one feed-tank supplying fresh vaporizable liquid to at least one said boiler through at least one intake conduit with a power-driven piloted pump under static head; at least one network of condensate discharge and return lines leading to at least one condensate recovery collector connected by at least one direct condensate reintroduction piping to the said boiler for discharging the condensates into the latter; at least one main circulation impelling member for discharging the said condensates into the said boiler; and at least one main condensate accumulation buffer-tank interposed between the said collector and the said direct reintroduction piping to form a main pumping sub-station in combination with the said circulation impelling member. The said circulation impelling member may be, for example, a power-driven pump or a gaseous fluid injector mounted in series preferably with a down-stream check valve and possibly maintained under static head through gravity feed from the said buffer-tank.

The improvements according to the present invention offer the advantages of improved, efficient and reliable working procedure and operation, of an organically simple and lasting structure, therefore of a relatively economical construction or manufacture and mounting requiring only reduced supervision and maintenance, as well as of a very economical working ensuring high energetic efficiency as a result of substantial gains in motive power, fuel and other kinds of employed and consumed energy, resulting in substantially increased rentability.

The invention will be better understood and other purposes, features, details and advantages of the latter will appear more clearly as the following explanatory description proceeds with reference to the appended diagrammatic drawings given solely as non-limitative examples illustrating the various presently preferred specific forms of embodiment of the invention and wherein.

Figure 1:
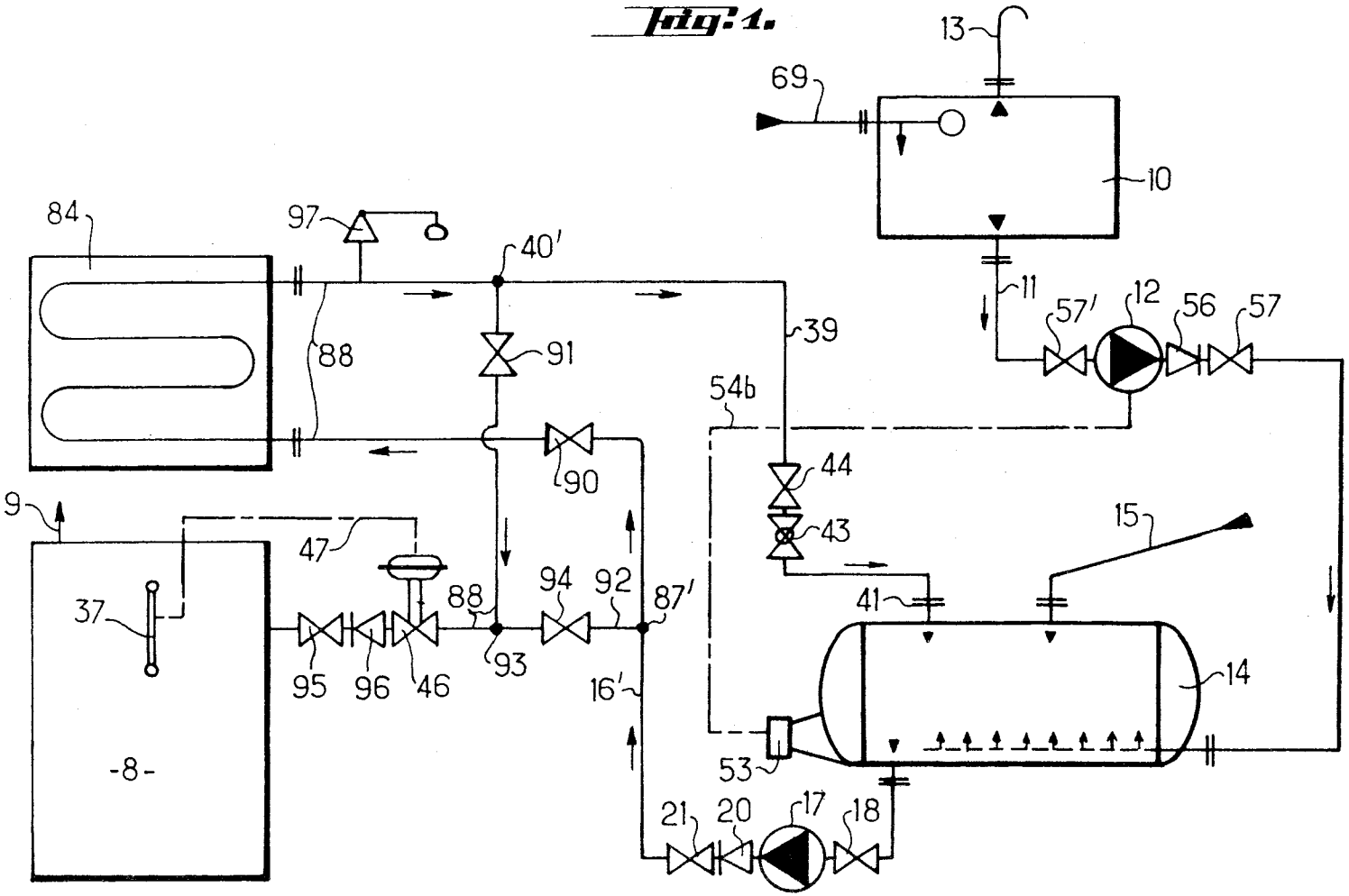
FIG. 1 illustrates the circuit diagram of a first form of embodiment of the invention showing the feed system for the supply of a boiler with vaporizable make-up liquid by a pumping sub-station fed from a feed-tank, the said circuit including an economizer.

The example of embodiment according to FIG. 1 illustrates a method and a device for re-feeding or replenishing at least one boiler with vaporizable make-up liquid (e.g. water) composed of external fresh liquid admitted from a free-liquid reserve and/or of condensates admitted from a condensate storage reserve. Means are provided for a common pre-heating of the said make-up liquid, prior to its admission into the boiler, by the hot combustion gases after their exit from the said boiler, in a manner known per se. The said pre-heating acts upon an ascending flow of said make-up liquid arriving from below and leaving from above.

FIG. 1 illustrates the application of the method to a continuous flow of said make-up liquid supplied from the said condensate storage reserve and part of which is diverted and recovered in the form of a permanent escape current of make-up liquid with a continuous, relatively low and possibly selectively controllable flow-rate. The said escape current is composed of the already pre-heated make-up liquid returning directly to the said condensate storage reserve and the said reserve of external feed liquid (feed-water) discharges directly into the said condensate storage reserve to which the said feed liquid is conveyed and mixed according to an intermittent flow-rate controlled automatically in interlocked follow-up relationship to the present amount of stored liquid.

The said pre-heating is performed generally, in installations such as, for example, boiler vapour-heating plants, by means of at least one economizer which is a heat exchanger traversed by the boiler combustion gases after their exit from the said plant, as well as by the make-up liquid, such as water, before its admission into the boiler, so that the economizer operates as a water heater by recovering the residual sensible heat of the burnt gases or the hot combustion products. The device according to the invention, serving to carry out the aforesaid method, is mainly applicable to condensable vapour production and distribution systems in which the temperature and pressure are substantially constant everywhere and identically the same at all points of the system, except for the flow pressure losses, and such a system, provided with an economizer, requires a certain number of precautions, the main ones of which are the maintenance of a minimum water flow-rate through the economizer and the elimination of a certain quantity of heat by the said economizer, therefore the passage through the latter of relatively cold water as compared with the temperature of the water contained in the boiler. The form of embodiment of the device according to FIG. 1, which is of the type defined previously, comprises at least one feed-tank 10 connected by a conduit 69, equipped for example with a float valve controlled by the water level in the tank 10, to a source of fresh water and constantly communicating with the surrounding atmospheric air through a vent or the like 13. Starting from the tank 10 is at least one feed water supply conduit 11 containing a power-driven piloted feed pump 12 sucking under static head from the lower part of tank 10 through the bottom of the latter, the said feed pump being mounted between a down-stream isolating valve 57 and an upstream isolating valve 57' and delivering the feed water through a down-stream check valve or the like 56. The boiler 8 produces condensable vapour which, through a main feed-line 9, reaches at least one system of vapour utilizing apparatuses (not shown) operating by way of heat exchange with heat absorption by condensing the vapour (such as, for example, ambient space heating radiators or heat exchangers), the condensates thus produced being discharged through at least one network of return lines leading to at least one condensate recovery collector forming a general gravity-return conduit 15 leading to and opening into the upper part of at least one main buffer-tank 14 located at a general low point of the installation. The supply conduit 11 opens into the bottom of the buffer-tank 14, the lower part of which is connected to the boiler 8 by at least one condensate direct-reintroduction piping 16' forming a common pipe 88 for the supply of the said make-up liquid and advantageously containing a shut-off valve or the like 90. The piping 16' contains at least one power-driven pump 17 advantageously mounted in series between an up-stream isolating valve 18 and a down-stream isolating valve 21 and sucking under static head from the buffer-tank 14 through the bottom of the latter and delivering preferably through a check valve or the like 20. An automatic control valve 46 is mounted in series in the common pipe 88 near the inlet of the latter into the boiler, advantageously between an up-stream isolating valve 91 and a down-stream isolating valve 95 with preferably a down-stream check valve or the like 96 placed in the pipe 88 between the boiler 8 and the valve 46. The servo-motor of the valve 46 is connected through a remote-control transmission 47 to the pilot member of a liquid level detector or controller 37 associated with the boiler 8. At least one economizer 84 is intercalated in series in the common piping 88 before the control valve 46 and the economizer 84 is so mounted as to have its inlet and its outlet connected to the up-stream or incoming portion and to the down-stream or outgoing portion, respectively, of the common pipe 88.

The individual servo-motor of the feed-pump 12 is connected by a remote-control transmission **54*b* to a liquid level detector or controller 53 associated with the buffer-tank 14. The said common pipe 88 is connected, at a point 40' located before the automatic control valve 46 and the isolating valve 91, to one of the aforesaid two make-up liquid sources through a branch conduit 39 forming an escape path opening preferably into the upper portion of the said source and containing a member 43 producing high pressure losses, notably by a restriction or a reduction of the free cross-sectional area of passage with a substantially constant, preferably selectively variable opening. The branching point 40' is located after the water outlet of the economizer 84, and the aforesaid source, into which the branch conduit 39 opens at 41, is constituted by the main buffer-tank 14**.

In order that, in case the economizer 84 should be put out of service by simultaneous closing of its up-stream and down-stream isolating valves 90 and 91, the make-up liquid may nevertheless reach the boiler 8, there is advantageously provided a by-pass conduit 92 containing an isolating valve 94 and connecting the condensate reintroduction piping 16' to the down-stream portion of the common pipe 88 after the economizer 84 by being connected at a point 87' to the piping 16' and at a point 93' to the common pipe 88 (between the control valve 46 and the isolating valve 91 of the latter). An isolating valve 44 is advantageously provided in the escape conduit 39.

The example of embodiment according to FIG. 1 offers the following features:

The condensates to be reintroduced directly into the boiler 8 are delivered into a flow-line after being mixed with the make-up water proceeding from the feed-tank 10.

The operation of the condensate direct-reintroduction pump 17 is continuous or permanent.

The periodical operation of the feed water pump 12 is controlled by the water level in the buffer-tank 14 by means of a level detector or controller 53 which starts the pump 12 when the said level falls below a minimum value, and then stops the said pump when the admissible maximum level is reached.

The level controller 37 regulates the feeding of the boiler with make-up water by acting upon the single automatic-control valve 46.

The economizer 84 may be isolated and put out of service by means of the valves 90, 91 and the boiler 8 is then fed directly with the condensates to be reintroduced and with make-up water through the shorting or by-pass conduit 92.

Owing to the possibility of closing the isolating valves 90 and 91 of the economizer 84, the latter is necessarily provided with a safety member such as a safety valve or the like 97 mounted on the common pipe 88.

The escape conduit 39 connected to the outlet of the economizer 84 allows a permanent minimum flow through the economizer to be obtained in the form of an escape flow ending into the buffer-tank 14. Since the passage of the condensates through the economizer 84 may result in vaporizing part of the said condensates, the passage of the liquid through the economizer is advantageously directed from bottom to top, for the vapour which is thus produced and tends to rise has no undesirable effect and the heated condensate as well as the vapour possibly produced are thus recovered from the top of the economizer.

The vapour which may thus be produced sometimes by the possible vaporization of the condensates is not lost, since it reaches and is collected in the buffer-tank 14 from which it may be conveyed to the utilizers.

The feed water is not delivered directly to the boiler 8, but is supplied to the buffer-tank 14 in order to be mixed with the stored condensates.

Figure 2:
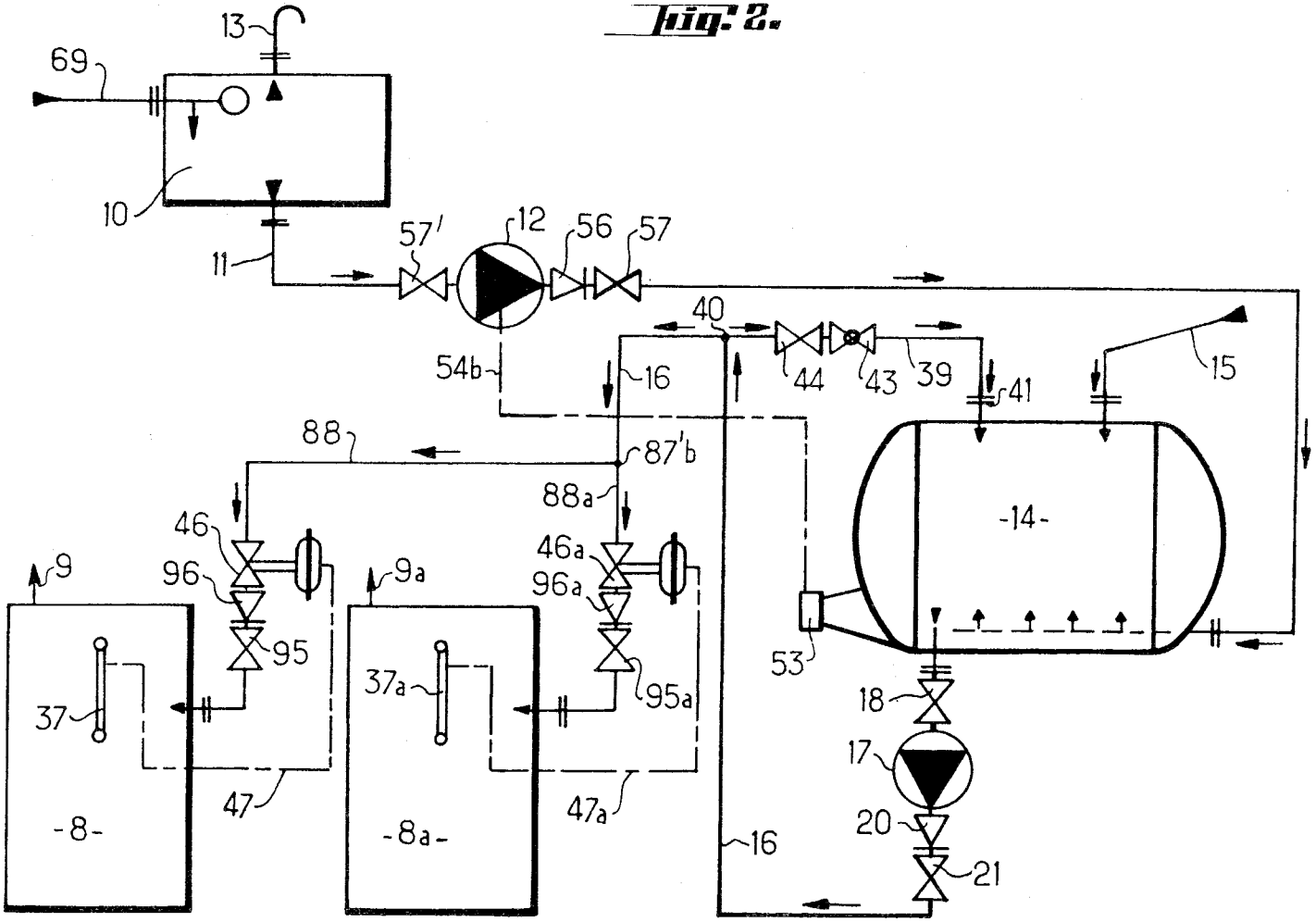
FIG. 2 is a modification of the circuit of the foregoing Figure, in which no economizer is used and two boilers are mounted in parallel.
Figure 3:
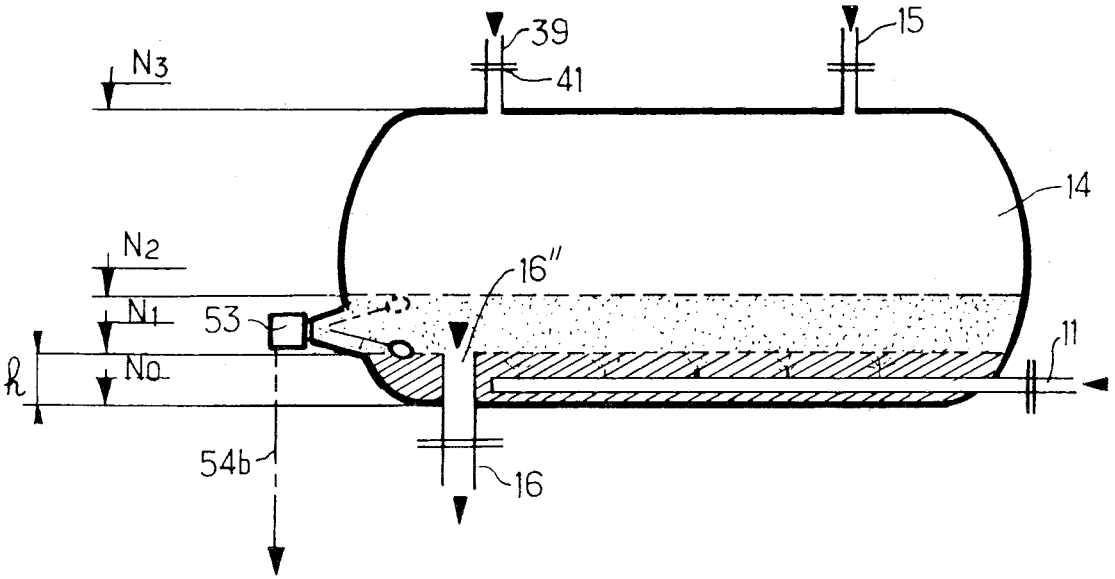
FIG. 3 is an enlarged isolated sectional diagrammatical view of the main buffer-tank of FIG. 2, illustrating the various characteristic levels in the latter.
Figure 4A:
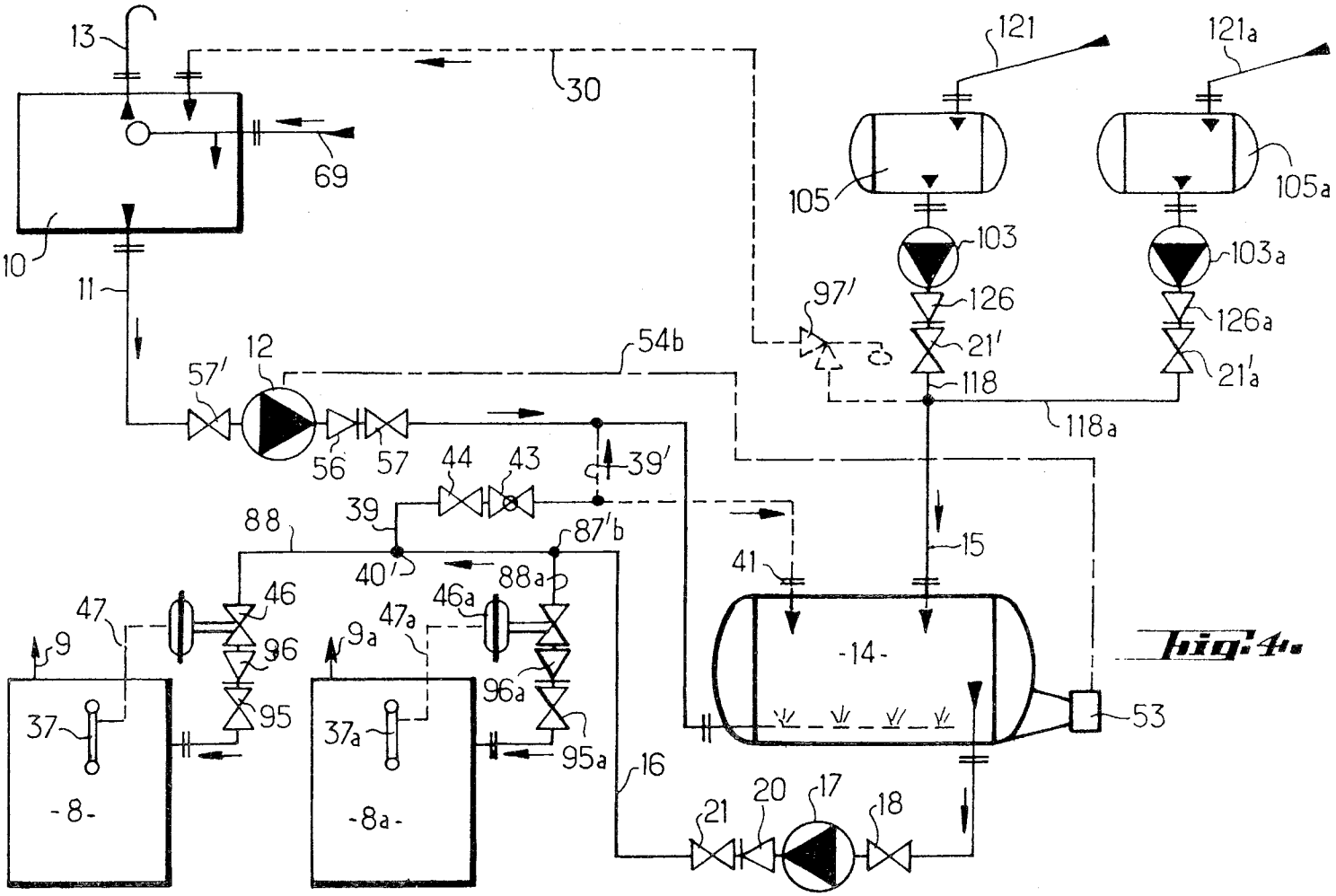
FIG. 4 shows a modified form of embodiment of the circuit of FIG. 2, with auxiliary pumping sub-stations feeding the main pumping sub-station.

This principle is also applied in the forms of embodiment of FIGS. 2 to 4 which result from an application of the principle of FIG. 1 to the multiple boiler system, possibly without economizer. It is known that, in a plant involving direct reintroduction of the condensates into several boilers, the admission of the condensates to be reintroduced into each boiler should be controlled. It is also necessary to be able to control individually the admission of make-up water every time the water level in each boiler considered individually reaches a lower limit value. A drawback to this is that it requires the adjunction, to the existing plant of a second control of the water level in the boiler, or in each new plant, the provision of two independent controls for each boiler.

The present invention allows this drawback to be removed in the case of a system with, for example, several boilers forming a set of vapour generators, and the method according to the invention is characterized in that the aforesaid permanent escape current which is returned to one of the two make-up liquid sources with the feed liquid supply flow or is returned directly to the single main condensate storage reserve which is common to all the boilers, whereas the said feed liquid reserve, which also is a single reserve common to all the boilers, discharges directly into the said condensate storage reserve to which the said feed liquid is supplied and mixed according to an intermittent flow controlled automatically in interlocked follow-up relationship to the present amount of stored liquid. According to another feature of the invention the admission flow of the said feed liquid into the said main storage reserve is interlocked in follow-up relationship with a predetermined minimum amount of liquid maintained in the said storage reserve to heat the said flow entering the cold feed liquid by being dispersed in this residual minimum mass of hot liquid.

The device according to the examples of embodiment of FIGS. 2 and 4 is characterized in that the permanent escape conduit 39 opens either into the feed water supply conduit 11 after the feed-pump 12 (through a length of conduit 39' indicated by a dotted line in FIG. 4), or in the upper portion of the single main buffer-tank 14 (as indicated by a continuous plain line in FIG. 2 and a length of conduit materialized by a dotted line in FIG. 4), whereas the common pipe 16 for direct reintroduction of the condensates is connected in parallel with several (e.g. two) boilers 8, **8*a* through conduits 88, 88*a*, respectively, each of which contains an automatic control valve 46, 46*a*, and the feed water supply conduit 11** opens, as in the case of FIG. 1, into the bottom portion of the main buffer-tank, the level detector or controller 53 of which is connected by a remote-control transmission 54*b* to the feed-pump 12, the main pump 17 for direct reintroduction of the condensates being, in this case, a continuously operating pump. According to another feature of this device, the suction pipe of the main pump 17 passes through the lower bottom of the main buffer-tank 14 and enters the latter substantially vertically, up to a height corresponding to the minimum amount of liquid to be maintained in the buffer-tank 14.

Thus, owing to this arrangement, the use of a double control for each boiler is avoided by returning into the buffer-tank 14 located up-stream of the direct condensate-reintroduction pump 17, not only the condensates to be reintroduced, but also the make-up water proceeding from the feed-tank 10. It is understood that, in this case, the operation of the pump 17 must be continuous so as to allow the boilers to be fed according to their respective needs. The operation of the feed-pump 12 allowing the admission of fresh make-up water into the buffer-tank 14 will therefore be linked up with the lowering of the water level in the buffer-tank 14 to an admissible minimum value below which there may be the risk of having no more available condensates nor make-up water to deliver to the boilers. The permanent escape conduit 39 continuously returning into the buffer-tank 14 a small portion of the condensates withdrawn down-stream of the delivery pump 17 eliminates the risk of operating the latter with no possibility of delivery, i.e. with a zero output, in the case of absence of water requirements of the boilers, in particular during the simultaneous closing of the control valves 46, 46*a*.

FIG. 3 illustrates the special design of the buffer-tank 14, in such a manner that, at any moment, a certain minimum amount of water of a height or thickness h remains in the lower portion of the tank and rises above the bottom level $N_0$ of the latter up to the level $N_1$ (so that $h=N_1-N_0$). This is obtained by providing the upper suction orifice 16' of the piping 16 located at least at the said level $N_1$ or above this level of the minimum water volume. This allows the normally cold make-up feed water to be admitted through the admission conduit 11 by way of dispersion in this minimum volume of relatively hot or high-temperature condensates, thus preventing the occurrence of a pressure surge or hammering of thermal origin. The level controller 53 so acts as to start the feed-pump 12 when the level of the condensates in the buffer-tank 14 has lowered to the minimum level $N_1$ and to stop the feed-pump 12 in case the condensates in the buffer-tank should reach a higher level, e.g. an intermediate level $N_2$. In case the discharge conduit 39, 39' returns the condensates (delivered by the pump 17 and not admitted into the boilers 8, 8*a*) into the conduit 11 supplying the feed water to the buffer-tank 14, these condensates are dispersed in the water of the latter by the feed-pump or injector 12. This results in a saving in the power or energy (in particular electrical energy) consumption of the motors of both pumps 12, 17.

FIG. 4 illustrates a variant of application of the method of the invention, of the type using at least one auxiliary storage reserve of condensates collected by free or natural gravitational flow and delivered by forced mechanical supply into the aforesaid main storage reserve. This variant is characterized in that the said delivery of condensates takes place under a pressure approximating to the one existing in the said boilers. The device for carrying out the method comprises at least one and preferably several auxiliary pumping sub-stations, e.g. two such pumping sub-stations, each constituted by an auxiliary buffer-tank 105, 105*a* into which opens a condensate gravity-discharge collector 121, 121*a* and by an auxiliary pump 103, 103*a* maintained under static head by the associated auxiliary buffer-tank from which it sucks and the delivery conduit 118, 118*a* of which opens into the upper portion of the main buffer-tank 14 owing to the fact that the respective delivery conduits 118, 118*a* of these auxiliary pumping sub-stations unite into a common conduit 15 opening into the buffer-tank 14. These auxiliary pumping sub-stations deliver their condensates, under a pressure approximating to the one existing in the boilers, into the main buffer-tank which also receives the make-up feed water proceeding from the tank 10 and where the pump 17 sucks these condensates to deliver the same to the boilers. There may then be a risk of possible abnormal increase in pressure in the buffer-tank 14. This increase in pressure may result from the delivery of the condensates by the individual pumps of the various auxiliary pumping sub-stations notably in case of absence of needs in water in the boilers, therefore in the absence of a lowering of the level of the condensates in the buffer-tank 14 of the boiler plant. This risk of undesirable over-pressure can be eliminated, according to the invention, by providing at least one safety valve 97' connected to the upper portion of the main buffer-tank 14 or to the delivery conduit 15 of the various auxiliary pumping sub-stations, the outlet orifice of this safety valve being advantageously connected by a discharge pipe 30, for example to the upper portion of the feed-tank 10. In such a case, the various pumps operate with a momentarily zero or almost zero output and a maximum delivery head, so that the pressure in the main buffer-tank 14 may rise to a value exceeding the admissible limit determined by the setting of the safety valve 97' which then opens to release the excess pressure towards the feed-tank.

Figure 5:
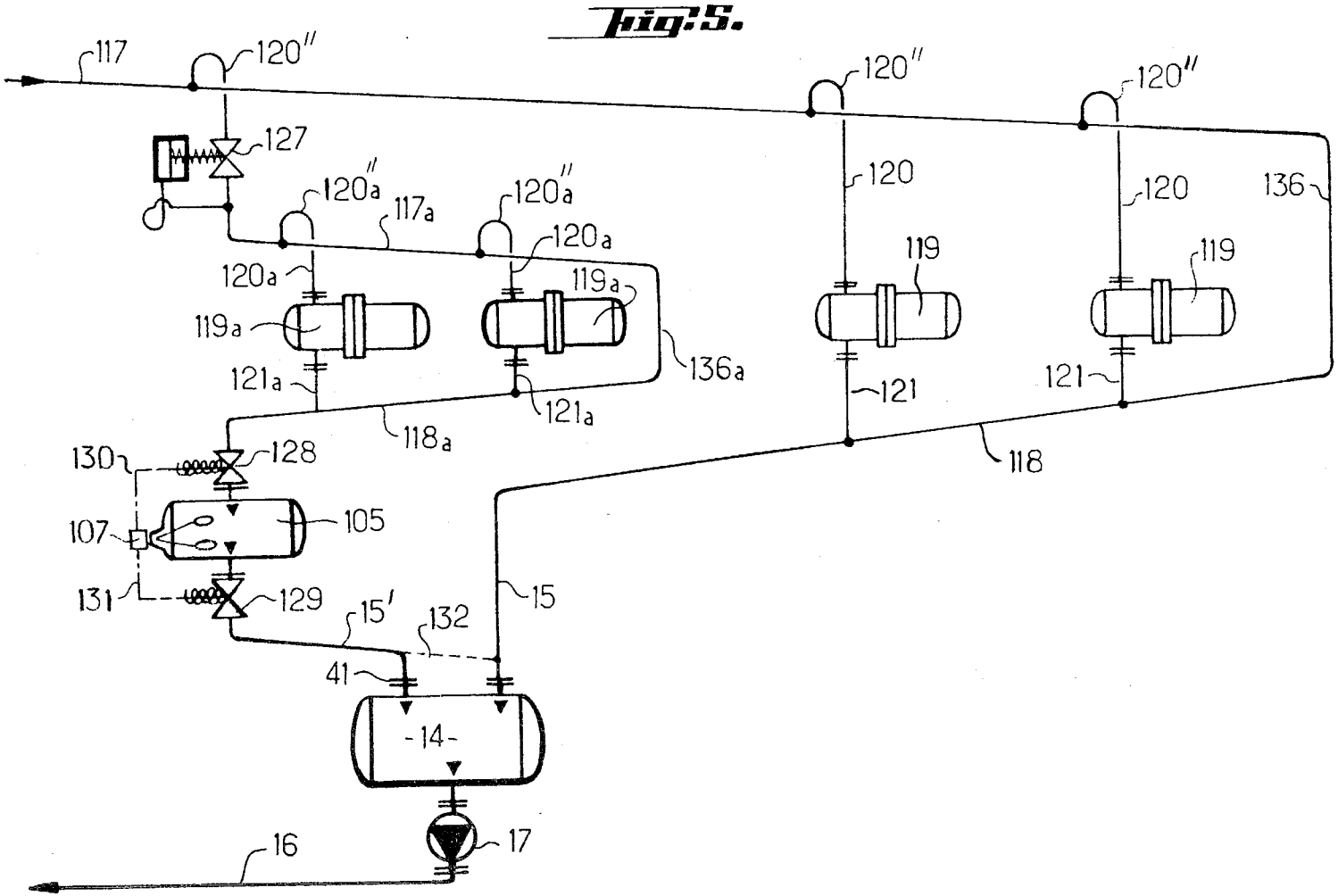
FIG. 5 illustrates the principle of a transfer lock arrangement for the condensates proceeding from a low-pressure network, in the main pumping sub-station of a high-pressure network, using an auxiliary buffer-tank in the low-pressure network interconnected with the high-pressure network.
Figure 6:
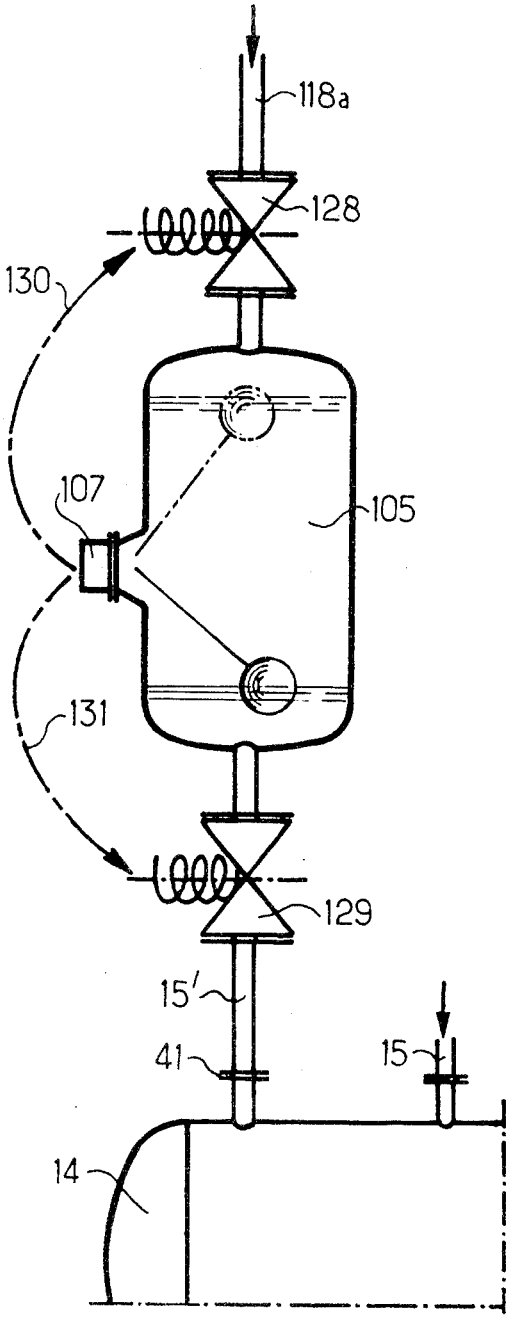
FIG. 6 is a fragmentary view, to a larger scale, of the interconnected main buffer-tank and auxiliary buffer-tank system.
Figure 7:
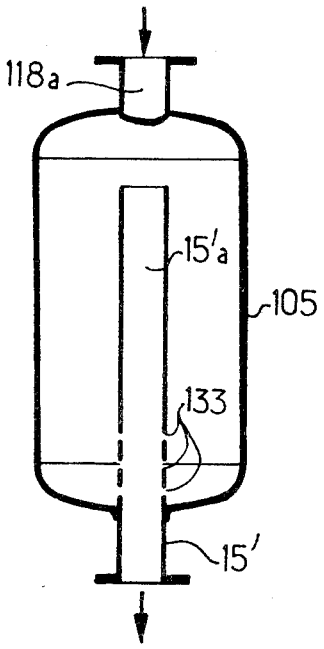
FIG. 7 is an isolated fragmentary view of the aforesaid auxiliary buffer-tank, showing a modified form of embodiment.
Figure 8:
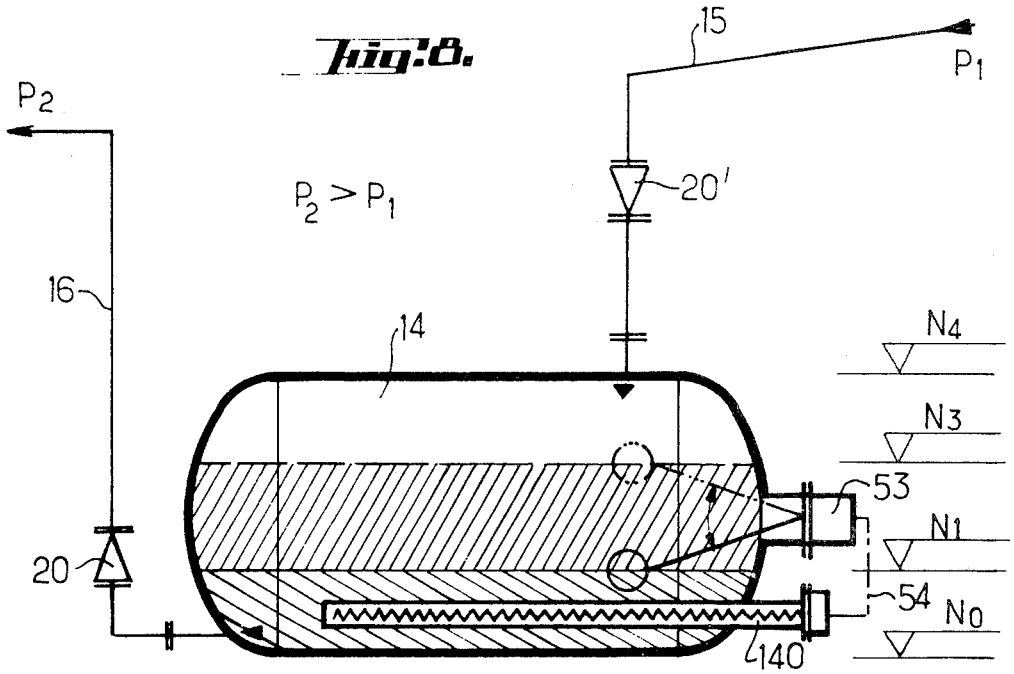
FIG. 8 is an isolated, longitudinal sectional view of a main condensate-collecting buffer-tank equipped with a means for internal heating of the condensates and illustrating the principle of a thermodynamic pumping sub-station.

FIGS. 5 to 7 relate to an improved low-pressure condensate transfer lock arrangement. It is known that, in a vapour plant wherein the pressure and temperature are practically or at least approximately constant everywhere and identically the same at all points, except for the pressure losses, the condensates are collected by gravity at one or several low local or general points of the system from which they are retaken and delivered for example mechanically in order to be reintroduced directly into at least one vapour generating boiler ensuring the production of feed vapour for the plant. A plant of this type therefore comprises networks of lines of vapour and condensates at substantially constant pressure and temperature, except for the flow pressure loss variations and one or several condensate pumping sub-stations for direct reintroduction of the condensates into the boilers. In the case of plants comprising several networks at different pressures obtained by expansion of the vapour up-stream of these networks as many pumping substations have to be provided as there are networks at different pressures. Each pumping sub-station also comprises a buffer-tank for gravity collection of the condensates and a delivery pump maintained under static head by this buffer-tank. The pumps of, respectively, each of these pumping sub-stations may deliver the condensates either directly into the vapour boilers by providing the necessary delivery head or into the condensate accumulation buffer-tank of another pumping sub-station serving a network of lines at a higher pressure, from which the pump of this latter pumping sub-station will, in its turn, deliver all the condensates admitted into its associated buffer-tank to return the same for example into a vapour boiler.

It is sometimes possible to design a plant at lower pressure with a low point located in geometrical superelevation with respect to that of the network of lines at higher pressure. In this case, the technical problem consists in discharging the condensates from the network at the lower pressure by mere gravity into the network at the higher pressure without using any delivery pump or equivalent means of forced circulation. On the other hand, free communication between the two networks with different pressures must be avoided, for such a free communication would result in automatically equalizing the pressures.

This technical problem is solved, according to the present invention, by providing a method of discharge and recovery of condensates from a system of production and distribution of condensable vapour in a closed circuit at approximately constant pressure and temperature, comprising at least one evaporating boiler and serving at least two systems of stations utilizing the vapour (through condensation of the latter) respectively at two different respectively high and low pressures. This method is of the type consisting in obtaining the vapour, feeding the low pressure system, for example by expanding part of the vapour feeding the high pressure system and in recovering at least part of the condensates discharged from each system by directed, preferably substantially dry and, at least for the most part thereof, free or natural gravitational return flow, the said condensates being collected and accumulated at least temporarily in an individual storage reserve and at least the condensates of the storage reserve of the said high-pressure system being reintroduced into the said boiler depending on the needs of the latter in vaporizable liquid by mechanically forced and possibly continuous circulation with automatic control or periodical or intermittent control of at least the condensate output flow-rate from the said storage reserve of the said low-pressure system; this control being obtained through floating on-off type regulation interlocked in follow-up relationship with the present measured or detected amount of condensates present in the said storage reserve of the said low-pressure system. The proposed new method is characterized by an automatic control or a periodic control of the condensate input flow rate into the said storage reserve of the said low-pressure system by way of, for example, floating on-off type regulation interlocked in follow-up relationship with the present measured or detected amount of condensates in the said storage reserve of the said low-pressure system, so that the respective controls of the said input and output flow-rates take place in opposite relationship to one another, the input flow being interrupted when the output flow is proceeding, and vice versa, and in that the said method consists in isolating the said storage reserve of the low-pressure system from the latter by stopping the input flow of condensates proceeding therefrom and then in equalizing the respective pressures in both storage reserves of both systems by providing a communication therebetween and in discharging by gravity the condensates from the said storage reserve of the low-pressure system into the said storage reserve of the high-pressure system.

In order to carry out this method, the present invention provides a condensate transfer lock device in a general system comprising at least two systems utilizing vapour at high pressure, and at low pressure, respectively, each including at least one live-vapour supply line (117 in the high-pressure system and 117*a* in the low-pressure system) feeding heat exchange apparatuses mounted for example in parallel (119 in the high-pressure system and 119*a* in the low-pressure system) and at least one condensate return line (118 in the high-pressure system and 118*a* in the low-pressure system) discharging the said condensates from the said apparatuses and opening into the upper portion of at least one buffer-tank located at the low point of the system considered (i.e. the buffer-tank 14 in the high-pressure system and the buffer-tank 105 in the low-pressure system). At least one of the two buffer-tanks and in particular the buffer-tank 105 of the low-pressure system may be provided with a level controller 107. The low-pressure live-vapour supply line 117*a* is in particular tapped off the high-pressure live-vapour supply line 117 through the medium of a steam pressure reducing valve 127 or a like automatic pressure regulator, whereas the high-pressure buffer-tank 14 is connected to the said boiler through a piping 16 for direct reintroduction of the condensates, leaving from the bottom of the said high-pressure buffer-tank 14 and containing a possibly permanently operating forcing pump 17 maintained under static head by the high-pressure buffer-tank 14 and sucking from within the latter. A motor-driven valve controlled automatically in interlocked follow-up relationship to the present water level in the said boiler is mounted for example in the piping 16 towards the inlet of this boiler. Each utilizer apparatus 119, 119*a* is connected between the two corresponding live-vapour supply lines 117, 117*a* and condensate return lines 118, 118*a*, respectively, through two live-vapour inflow pipes 120, 120*a* and condensate outflow pipes 121, 121*a*, each live-vapour inflow pipe 120, 120*a* being advantageously connected to the associated live-vapour supply line 117, 117*a* through the medium of an ascending crook or the like 120'', 120''*a* the concavity of which is directed downwards in order to prevent the condensates possibly present in the live-vapour supply conduit 117, 117*a*, from entering the inflow pipes 120, 120*a*.

This device is characterized in that the low-pressure buffer-tank 105 is located higher than the high-pressure buffer-tank 14, the upper portion or top of which is connected to the base of the low-pressure buffer-tank 105 through a drain conduit 15' permanently communicating with the high-pressure condensate return line 118 (connected to the buffer-tank 14 by the collector 15), whereas the low-pressure condensate return line 118*a* and the drain conduit 15' are respectively provided with two motor-actuated stop-valves 128, 129 located upstream and down-stream, respectively, of the buffer-tank 105 and the servo-motors of which are respectively connected through remote-control transmissions 130, 131 to the monitoring member of the level controller 107 mounted on the buffer-tank 105, so that the operation of this whole arrangement is cyclical and takes place as follows.

Initially, in the absence of condensates in the buffer-tank 105 of the low pressure system, the level controller 107 ensures simultaneously the closing of the down-stream valve 129 and the opening of the up-stream valve 128. The buffer-tank 105 is then at the pressure of the low-pressure system and the condensates accumulate therein by flowing by gravity from the line 118*a*. When the buffer-tank 105 is full, the level controller 107 ensures the opposite operations, i.e. the closing of the up-stream valve 128 and the opening of the down-stream valve 129. On the opening of the down-stream valve 129, the steam filling the upper portion of the high-pressure condensate return line 118 and/or of the high-pressure buffer-tank 14, passes through the pipe 15' and the down-stream valve 129 and enters from below the low-pressure buffer-tank 105, thus raising the pressure therein to the high-pressure value of the high-pressure system. Thereafter, when the pressure equilibrium is reached, the condensates flow by gravity from the buffer-tank 105 into the high-pressure system, i.e. into the buffer-tank 14 constituting the low point of the latter system. During that time the condensates of the low-pressure system continue to arrive through the line 118*a* and accumulate before the up-stream isolating valve 128. This circumstance must therefore be taken into account in designing the low-pressure system and in particular the condensate return line 118*a*. When the buffer-tank 105 of the low-pressure system becomes empty, its level controller 107 ensures a new filling-and-draining cycle with a repetition of the afore-mentioned operations. This arrangement offers the advantage of allowing the condensates to be discharged from a low-pressure system into a high-pressure system, saving at least one pump and various accessories.

The conduits 15 and 15' are in permanent communication with one another through the medium of the buffer-tank 14 and, possibly, also through a direct connecting conduit 132 represented by a dotted line in FIG. 5. The buffer-tank 105, which is advantageously cylindrical in shape, may be arranged either horizontally as shown in FIG. 5 or vertically as in FIGS. 6 and 7. According to another feature of the invention, the up-stream end of the drain conduit 15' penetrates or is extended into the low-pressure buffer-tank 105 up to the upper portion of the latter by a substantially vertical tube 15'*a* provided at its base with orifices 133. The tube 15'*a* facilitates the upward passage of the high-pressure vapour proceeding from the buffer-tank 14 when the cycle or operation is reversed, i.e. when the isolating valve 129 is opened, whereas the lower orifices 103 allow the condensates in the buffer-tank 105 to enter the drain-pipe 15'.

FIGS. 8 to 20 illustrate the application of an original principle to produce the mechanical impulsion or the acceleration necessary for the forced delivery of the condensates to be reintroduced directly into the boiler. In a vapour plant where the pressure and the temperature are practically constant everywhere and substantially identically the same at all points (except for the pressure losses), the condensates reach by gravity a general low point, out of which they must be forced under a higher pressure in order to be reintroduced directly into the vapour generating boiler. This difference in pressure, to be produced between the system of condensate gravity-flow lines (the pressure of which is substantially equal to the pressure in the boiler, less the pressure losses in the vapour phase circuit) and the inlet into the boiler, is equivalent to the total, on the one hand, of the liquid-phase pressure losses between the low point of the systems of condensate gravity-return flow lines and the inlet of the boiler, and, on the other hand, the net geometrical height up to which the condensates must be forced (i.e. the difference between the water levels at the said low point and in the boiler, respectively). The said upper pressure is thus necessary to overcome either the geometrical height of a pitch-retaining pipe rise or the pressure difference (possibly increased by the difference in geometrical height) between two systems at different pressures, in order to force the condensates from the lower-pressure system into the higher-pressure system, out of which the condensates will be forced together with those of the higher-pressure system.

This pressure difference is usually provided mechanically, for example by a rotating device such as a rotary pump or the like. For a great number of technical and economical reasons, it is desirable to avoid the use of a mechanical forcing pump for the direct reintroduction of the condensates into the vapour generating boiler. Among such reasons, the following should be mentioned:

the desire to reduce financial investments;

the desire to reduce maintenance costs (wear of moving members under severe temperature and pressure conditions);

the elimination of the risk of cavitation of the pump (very rapidly resulting in very strong wear and considerably reducing the hydraulic characteristics) or the elimination of the necessity of a required high sucking net positive static head to be produced by the water level up-stream of the pump, i.e. in the buffer-tank;

the elimination of the requirement of cooling of the rotary shaft bearings and seals;

the almost complete elimination of the risk of stoppage in case of failure or of the necessity to provide for stand-by or emergency devices;

the elimination of the necessity to provide for isolating members, filters or like accessories on the pump in operation as well as on the stand-by pump.

In order to solve this technical problem, the invention provides a method of forced delivery, notably intermittent forced delivery, of condensates either for direct reintroduction into a vapour generating boiler or for forced delivery into a system at a higher pressure or for the passing of a geometrical rise such as a pitch-retaining pipe rise by a condensate discharge flow in a system of production, distribution and utilization of condensable vapour in a closed circuit where the pressure and temperature are substantially constant everywhere and identically the same at all points except for the pressure losses, with recovery of at least part of the condensates discharged by guided, preferably substantially dry and, at least for the most part thereof, generally gravitational return flow into at least one closed container for at least temporary collection and accumulation forming a main buffer-tank or the like located at a local or general low point. This method is characterized in that it consists, in a manner known per se, in awaiting the obtention of a predetermined maximum level of filling of the said buffer-tank with liquid; in isolating, from outside, the upper space of the said buffer-tank containing the gaseous phase by cutting off all at least unidirectional fluid communication with at least the up-stream portion of the said system or in stopping the up-stream admission and in preventing any return of the down-stream current of the condensates into the said buffer-tank; and in applying, at the free surface of the contained liquid, a sufficient additional vapour pressure to allow the total available gas pressure to be substantially equivalent to the sum of the necessary net geometrical delivery height and of the down-stream flow pressure losses to be overcome.

According to another feature of this method, there is provided a control cyclical operation with periodical repetition with automatic control in interlocked follow-up relationship to the present amount of condensates present in the said container forming the said buffer-tank in a manner known per se.

The device according to FIGS. 8 to 20, for the carrying out of the aforesaid method, comprises at least one main buffer-tank 14, 105 provided with at least one maximum and minimum level controller 53, 107 and intercalated in an inclined descending condensate-return conduit 15, 125 opening into the said boiler, the said main buffer-tank being placed either at a general low point to form a pumping sub-station for direct reintroduction into the boiler, or at a local low point or a pitch-retaining pipe rise, to form a lift-pumping sub-station for geometrical rise passing, the up-stream portion 15 or 101' and down-stream portion 16 or 116' of this conduit being connected to the upper and lower portions, respectively, of the main buffer-tank 14, whereas a check valve or the like 20, 20' is intercalated in the said down-stream conduit portion 16 or 106'. This device is characterized by means for additional introduction or local production of vapour in the upper space of the main buffer-tank 14, the said means comprising a piloting or switching member connected by a remote-control transmission 54, 54'', 124 to the monitoring member of the aforesaid level controller 53, 107, whereas, in a manner known per se, a check valve 20' is mounted in series in the said up-stream conduit portion 15, 101, 101'.

According to one form of embodiment, the said method consists in heating at least part of the liquid phase, present in the said container forming the buffer-tank, through external heat supply in order to raise its temperature and vaporize part of the said liquid in order to increase the pressure and thus create a thermodynamic pumping effect producing the circulating impulsion. This theoretical principle is understood by considering a closed container such as a buffer-tank 14 in FIG. 8, filled with condensates (liquid water in the case considered) at any temperature and the uncondensable products of which have been previously discharged. The upper portion of this container, not occupied by the liquid phase, contains the vapour which is at a pressure corresponding to the temperature of the liquid on the saturation vapour tension curve for the vapour of the fluid considered (which in this case is water). If this liquid water is heated by any means 140 while the container 14 is kept always closed, to each new temperature strictly corresponds a new pressure which is always situated on the saturation vapour tension curve. It is therefore sufficient to heat the condensates, contained in the buffer-tank 14 placed at the general low point of the system of condensate gravity-return lines or at the local low point of the condensate return pipe rise, in order to increase their pressure concomittantly with the increase of their temperature. Starting from a certain pressure increase value, it is thus possible to directly reintroduce the condensates into the vapour boiler or to make them pass the pipe rise. Thus, the desired efficient or useful pressure increase is obtained simply by heating the contained condensates from the initial temperature to the final temperature to cause them to pass from an initial pressure to a final pressure. At the beginning of this heating cycle, the volume located below the condensates is filled with saturated vapour at a pressure corresponding to the temperature defined on the saturation vapour tension curve. The increase of the temperature also results in a vaporization, the importance of which is determined by the difference between the total heats or enthalpies contained in the initial and final masses, respectively, of the vapour confined in the container 14. Thereafter, a constant and complex mutual heat exchange takes place in both directions between the mutually contacting vapour and condensates. As a matter of fact, the actual heating power to be furnished for such a thermodynamic pump is simply that which is necessary to raise the temperature of the liquid phase or water of the working fluid from the initial temperature to the final temperature. Thus, when the upper condensate-level $N_3$ is reached in the tank of the thermodynamic pump, the space comprised between this upper level $N_3$ and the top $N_4$ of the tank contains saturated vapour under the same pressure and at the same temperature as the condensates, therefore at the pressure called initial pressure. In order that these condensates may thereafter be delivered by means of the thermodynamic pump, it is necessary that, at the end of the delivery cycle, the initial volume of condensates be replaced by saturated vapour at the pressure called final pressure. In order that the condensates may be delivered it is therefore necessary to furnish a heating power which is sufficient on the one hand, to raise the temperature of the condensates from the initial value to the final value, therefore to furnish sensible heat; and on the other hand, to vaporize the necessary weight of water to allow the vapour thus produced to occupy, at the final pressure, the volume of the vaporized condensates and the portion of the volume of initial vapour given up by the latter with the increase of its pressure, therefore the increase of its density. This vaporization necessitates the supply of vaporizing heat.

From the total of the two foregoing items, it is necessary to deduce the difference between the latent vaporizing heats at the initial and final pressures, respectively, of the initially present weight of vapour. It is found that the greater part of the heating power to be furnished serves to raise the temperature of the liquid water and, since this power is furnished to the fluid (water) itself, it is integrally contained in the condensates at their inlet into the boiler and is totally recovered in the latter, so that it is to be deduced from the power to be furnished by the boiler, therefore from the heating fuel consumption in the furnace of the latter. If the heating power thus furnished to the condensates is for example of electrical origin, its unit-price in the thermodynamic pump will be substantially higher than that of the power furnished to a boiler whose furnace is fed with relatively less expensive fuel. On the other hand, this power consumption in the thermodynamic pump is relatively higher than the power consumption in a mechanical pump offering the same characteristics. It results therefrom that the thermodynamic pumping device according to the invention is justified essentially in cases of small over-pressures and small flow-rates which are difficult characteristics to obtain by means of the conventional pumps, as well as in the case where the net positive sucking head required by a conventional pump is prohibitively high.

According to the forms of embodiment illustrated in FIGS. 8 to 18, the aforesaid heating means are constituted by at least one heating resistor 140 or an equivalent heat supply means in transmission and heat-exchange connection with at least part of the lower volume of condensates contained in the main buffer-tank 14 or 105. The switching on or off of this heating resistor is controlled by means of the remote-control transmission 54 or 124 by the level controller 53 or 107. In FIGS. 8, 9 and 15 to 18, when the float of the level controller 53 or 107 reaches the upper level $N_3$ during the rise of the condensates in the buffer-tank 14 or 105, the level controller ensures through the remote-control transmission 54 or 124 the switching on of the heating resistor 140 which then heats the condensates to increase their pressure from the value $P_1$ (which is substantially the pressure within the boiler) to the value $P_2$ necessary to force up the condensates for their direct reintroduction into the boiler. During this forced delivery, the level of the condensates lowers in the buffer-tank and, when they reach a lower level $N_1$, the level controller 53 automatically ensures the switching off of the heating resistor 140.

According to another general feature of the aforesaid method, illustrated in FIGS. 9 to 11 and 15, 16 and 19, provisions are made for a temporary collection and accumulation of the condensates in at least one auxiliary buffer-tank 105' up-stream of the main buffer-tank 14 during the forced delivery of the condensates from the latter by way of pumping. According to another general feature of the aforesaid method, illustrated in FIGS. 9 to 11 and 16 to 20, means are provided for preferably automatic vapour-pressure release, known per se, from the main buffer-tank 14 or 105 at the end of the forced delivery cycle, and this release is continued until the said vapour pressure in the said buffer-tank again becomes substantially equal to the pressure of the condensates up-stream of the said main buffer-tank. According to still another feature of the aforesaid method, the equalization of the aforesaid pressures is obtained by providing a direct temporary and controlled communication between the respective upper gaseous-phase confinement spaces of the said main and auxiliary buffer-tanks, respectively, or between the upper space of the said main buffer-tank and either the up-stream admission flow of condensates or the preferably up-stream supply flow of live vapour in case of afore-mentioned pitch-retaining arrangement as illustrated in FIGS. 9 to 11 and 16 to 20.

Figure 9:
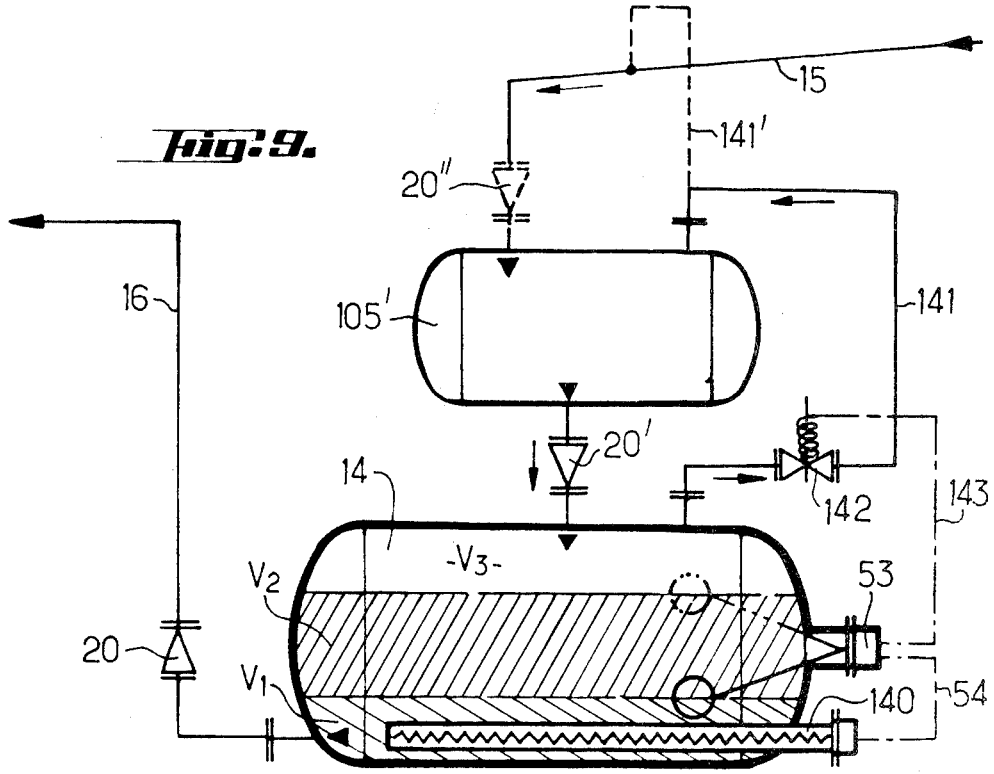
FIG. 9 is a view similar to FIG. 8, but where the thermodynamic pumping sub-station is preceded by an auxiliary buffer-tank for temporary accumulation of the condensates, with pressure discharge from the main buffer-tank into the auxiliary buffer-tank.

An arrangement for applying the aforesaid characteristic features of the method is illustrated in FIG. 9, wherein at least one auxiliary buffer-tank 105' is intercalated in series in the up-stream portion 15 of the condensate return conduit before the afore-mentioned check valve 20' of the latter and possibly after an additional up-stream check valve 20''. The upper portion of the main buffer-tank 14 is connected by at least one vapour discharge conduit 141 either to the upper portion of the auxiliary buffer-tank 105' into which it opens, or (as shown by a dotted line 141') to the up-stream portion 15 of the condensate return conduit, preferably before the check valve 20'', through the medium of a preferably motor-actuated stop valve 142 whose servo-motor is connected through a remote-control transmission 143 to the monitoring member of the level controller 53. The capacity of the auxiliary buffer-tank 105' is preferably substantially equal to the condensate volume $V_2$ defined between the uppermost and lowermost positions corresponding to the maximum level $N_3$ and the minimum level $N_1$, respectively, of the float or the sensing member of the level controller 53 in the main buffer-tank 14 which respectively switch on and switch off the heating means constituted by the resistor 140.

The operation of the device of FIG. 9 is as follows: assuming the main buffer-tank 14 to be initially substantially empty or to contain only a minimum condensate volume $V_1$ sufficient to bathe or submerge the heating means 140, the detecting means, for example the float means, of the level controller 53 is in its lowermost position (indicated by a plane line in FIG. 9) corresponding to the minimum level $N_1$ so that the heating means 140 is not switched on and the valve 142 is open, thus providing a communication between the upper, vapour-phase space (capacity $V_3$) of the main buffer-tank 14 and the upper space of the auxiliary buffer-tank 105' for the mementary storage of the condensates, thus resulting in an equalization of the respective pressures in these two tanks, causing the pressure in the main buffer-tank 14 to become equal to the pressure in the condensate gravity-flow system, thus leading to the opening of the non-return valve 20'. Consequently, the condensates temporarily accumulated and retained in the auxiliary buffer-tank 105' can freely flow by gravity through the check valve 20' to enter the main buffer-tank 14 and fill the same up to a predetermined level $N_3$. When the detecting member of the level controller 53 is thus raised to its uppermost position corresponding to the maximum level shown in FIG. 9, the level controller 53 automatically ensures the closing of the valve 142 and the operation of the heating means 140 until the necessary delivery pressure $P_2$ causing an at least partial emptying of the main buffer-tank 14 is obtained, after which the afore-described cycle is thus repeated periodically and indefinitely.

Figure 10:
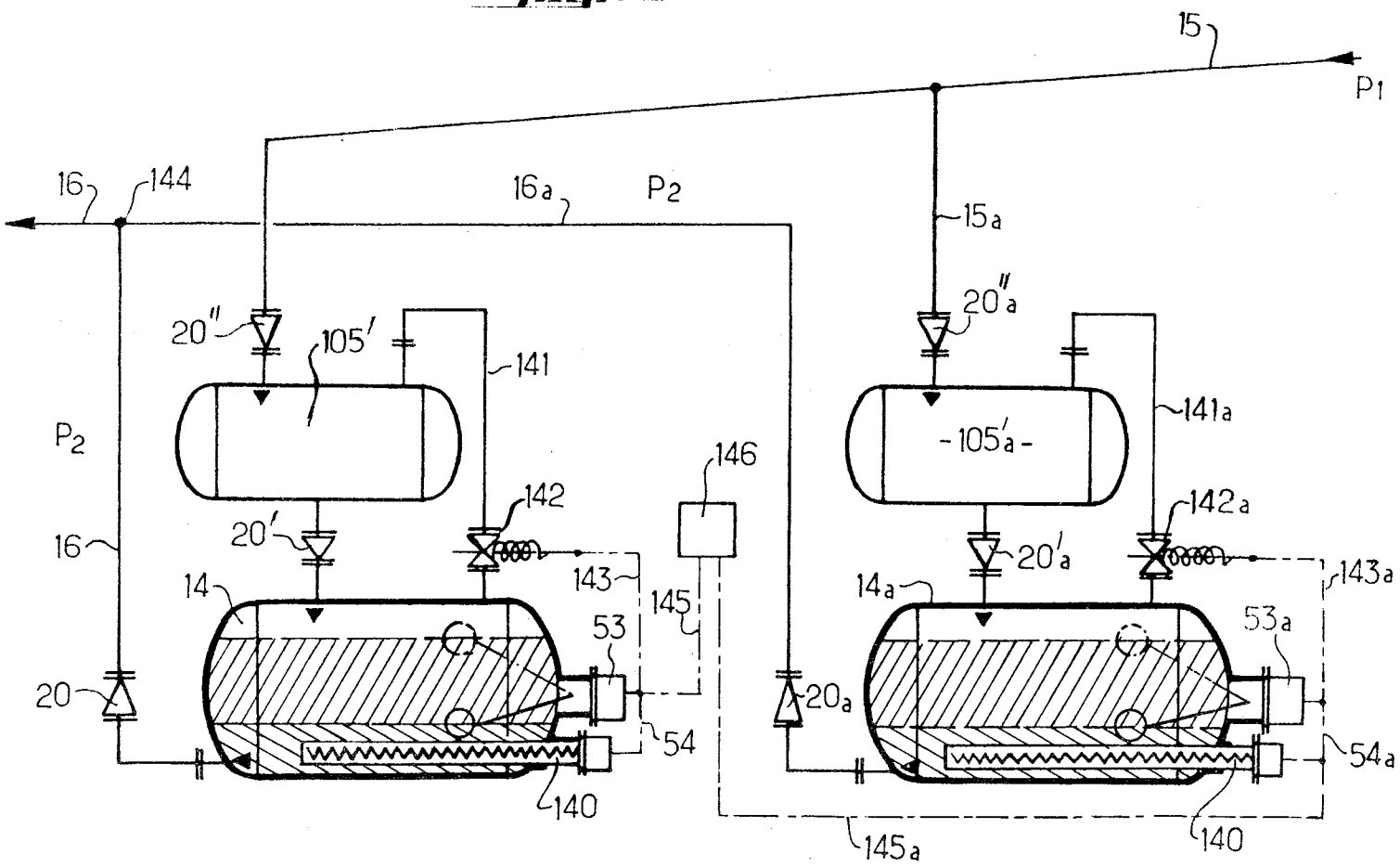
FIG. 10 shows two systems, respectively similar to that of FIG. 9 and mounted in parallel in one and the same condensate return network.

FIG. 10 illustrates the application of the aforesaid method to at least two pumping sub-stations mounted in parallel, the said method being characterized, in this case, by an automatic time-lag or delay interlocked in follow-up relationship with the present amounts of condensates contained in the individual main buffer-tanks of the said pumping sub-stations in order to throw their respective operations out of step with respect to one another for the purpose of a possibly substantially continuous replenishment of the said boiler with liquid to be vaporized through separate operation of a sub-station during the filling of the other with condensates. FIG. 10 shows an arrangement for the carrying out of this method in a system where each said pumping sub-station is identical with the one shown in FIG. 9, the elements of the second sub-station being designated by the same reference numerals as those of the first one accompanied by the index a. The condensate delivery pipings 16, **16*a* unite at a point of confluence 144 into a common single piping for the reintroduction of the condensates into the boiler, whereas the condensate gravity-return conduit 15 leading to the auxiliary buffer-tank 105' of one of the pumping sub-stations feeds the auxiliary buffer-tank 105'*a* of the other pumping station through a branch conduit 15*a*. This arrangement is characterized in that the monitoring member of the level controller 53, 53*a* of each main buffer-tank 14, 14*a* is connected by an individual remote-control transmission 145, 145*a*** to a member forming a time-lag regulator relay which allows continuous direct reintroduction of the condensates into the boiler to be obtained owing to both the thermodynamic pumping sub-stations operating alternately to deliver the condensates, one of the stations delivering the condensates by emptying its main buffer-tank while the main buffer-tank of the other is filling, and vice versa.

Figure 11:
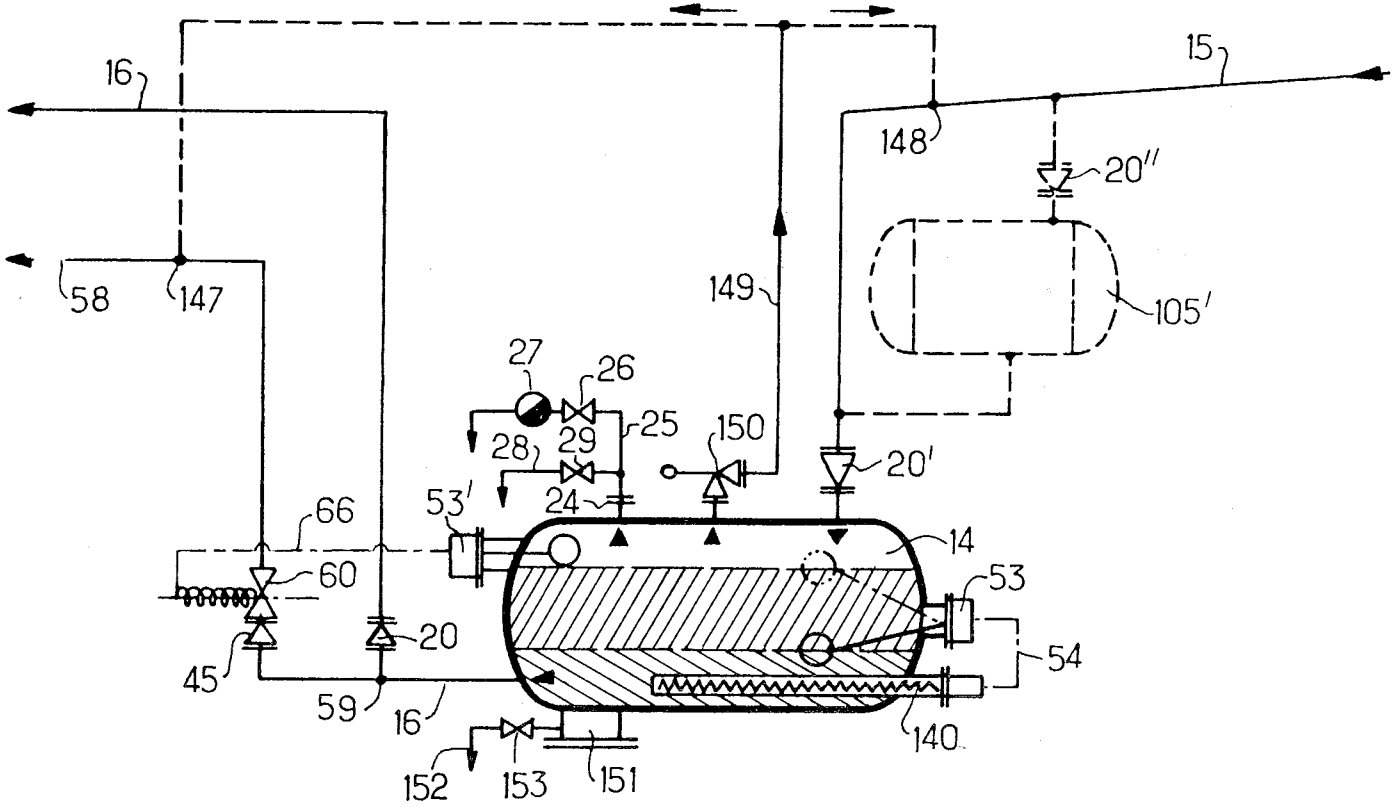
FIG. 11 is a view similar to FIG. 9, but to a smaller scale, showing the aforesaid main buffer-tank provided with excess condensate discharge means and over-pressure discharge means.

FIG. 11 illustrates an additional modification of the method of the invention, according to which a safety discharge may be provided to discharge the excess condensates which are present in the main buffer-tank 14, notably into a feed-tank or into a lower-pressure system (not shown), the said safety discharge being preferably interlocked in follow-up relationship through automatic control with the admissible maximum liquid level in the main buffer-tank, in particular in case of absence of needs or of reduced needs of the vapour boiler in liquid to be vaporized. This variant is characterized by a safety discharge of vapour in case of over-pressure in the main buffer-tank (due to the temperature rise in the latter in the absence of discharge of the condensates), this discharge being interlocked in follow-up relationship through automatic control with the maximum admissible pressure and taking place either into the excess condensate discharge line or into the up-stream admission flow of condensates.

In the arrangement illustrated in FIG. 11 and intended for the carrying out of this method, at least one or each main buffer-tank 14 of the system may be provided with an upper level controller 53' and has its lower portion connected to a feed-tank or to an aforesaid lower-pressure system by at least one condensate discharge conduit 58 advantageously containing a check valve 45 and a motor-actuated stop valve 60 whose servo-motor is connected through a remote-control transmission 66 to the monitoring element of the said upper-level controller 53'. This condensate discharge conduit 58 is connected at a confluence point 59 to the condensate delivery piping 16. This arrangement is characterized in that the upper portion of the main buffer-tank 14 is connected to the condensate discharge conduit 58 (at a point 147 located down-stream of the valve 60) or to the up-stream portion of the condensate return conduit 15 (at a point of connection 148 located up-stream of the check valve 20') by a safety relief conduit 149 containing a safety valve or the like 150; these two possibilities of connection of the conduit 149 are indicated by dotted lines in FIG. 11. The condensate gravity-return conduit 15 may lead to the main buffer-tank 14 either directly as indicated by a full line in FIG. 11 or indirectly through an auxiliary buffer-tank 105' preceded by a non-return valve 20'' as indicated by dotted lines in the same Figure. The main buffer-tank 14 may also be provided with a bleeding conduit 25 for the non-condensable substances, containing an automatic bleeder 27 preceded by a stop-valve 26, a bleeding conduit 28 provided with a manual drain-cock 29 being connected in parallel to the conduit 25 in a manner known per se. The main buffer-tank 14 is also provided in its bottom with a decantation pot 151 provided with an emptying outlet 142 equipped with a stop-valve 153.

The operation of the arrangement just described is as follows: when the main buffer-tank 14 has been filled with condensates up to the predetemined level starting the operation of the level controller 53, the latter sets the heating means 140 to work, thus causing the condensates to be delivered or forced out from the main buffer-tank 14 through the piping 16 as a result of a thermodynamic effect. If the needs of the boiler or of the higher-pressure system re-fed with the thus delivered condensates are smaller than the flow rate of delivery of condensates as a result of the said thermodynamic effect, the condensates in the main buffer-tank 14 may possibly continue to rise up to a level which causes the upper level controller 53' to operate and bring about the opening of the valve 60 (generally closed during normal operation), thus allowing the excess condensates to be discharged through the discharge conduit 58 and all the possible vapour over-pressure in the upper space of the buffer-tank 14 to be discharged through the safety valve 150 and the discharge conduit 149.

Figure 12:
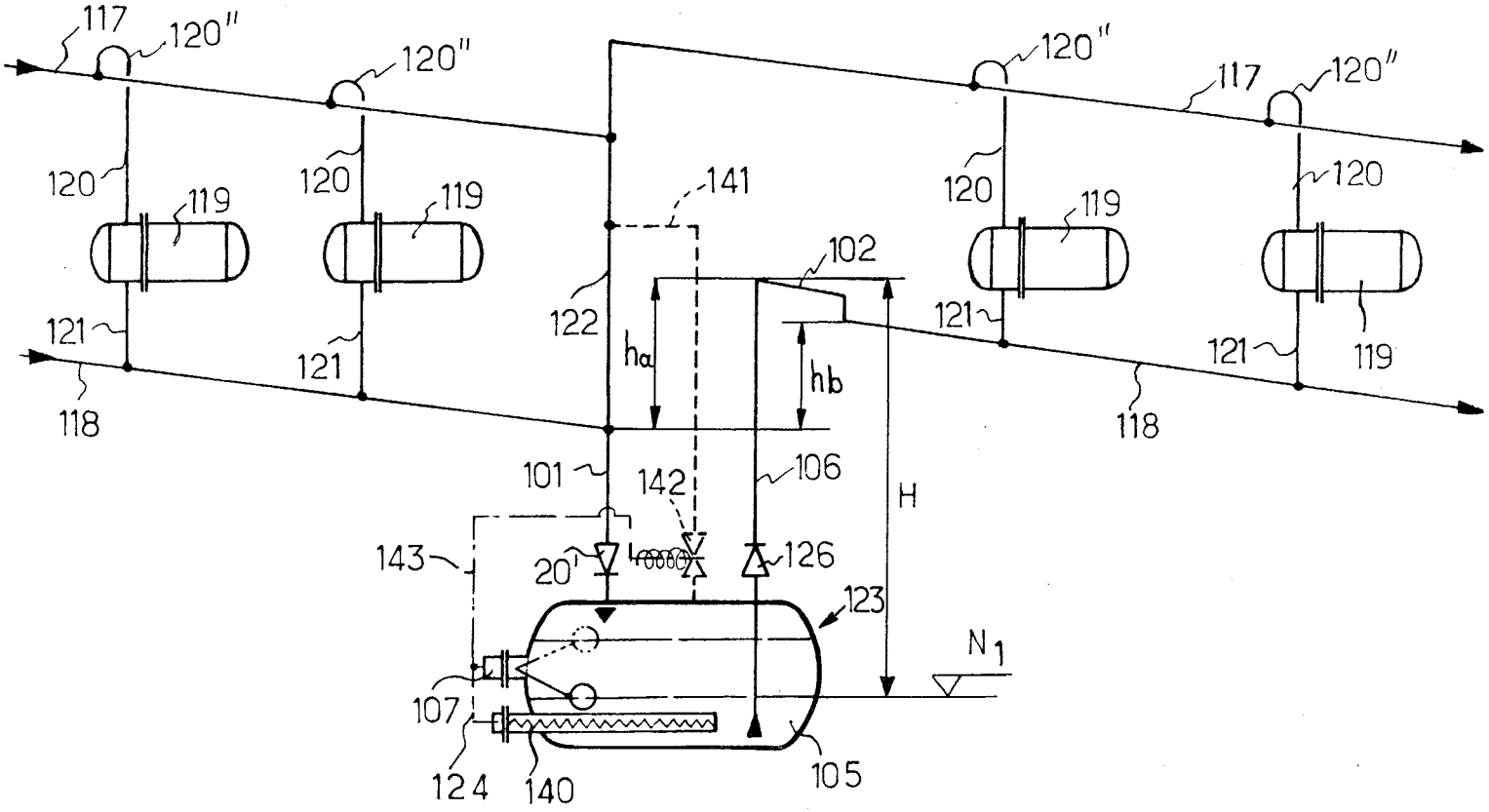
FIG. 12 is a fragmentary view of a two-pipe network of condensable vapour utilizer apparatuses, including a common condensate return conduit with a pitch-retaining pipe rise provided with a thermodynamic pump.

FIG. 12 illustrates the application of the foregoing principles to a two-pipe system including at least two distinct line systems for, respectively, the admission of live vapour (117) and the discharge of condensates (118), between which are connected, in parallel or in derivation, vapour user or utilizer apparatus or vapour consumer stations such as for example heat exchangers 119 each of which is connected to a common main vapour-admission conduit 117 and to a common main inclined descending condensate - return conduit 118 through a vapour inlet pipe 120 and a condensate outlet pipe 121, respectively, the inclined condensate-return conduit 118 being provided with at least one pitch-retaining pipe rise 123 provided with an aforesaid main buffer-tank 105 with at least one vapour-phase direct-connection conduit 122 between the two systems or conduits 117, 118, the said vapour-phase direct-connection 122 interconnecting the upper point of the descending branch 101 of the said pipe rise 123 with the live-vapour admission conduit 117. The buffer-tank 105 is placed at the low point of the pipe rise 123, the descending vertical branch 101 of which opens into the upper portion or the vapour-phase space of the buffer-tank through the check valve 20' and the ascending vertical branch 106 of which enters the tank 105 so that its lower open free end opens therein substantially in proximity to the bottom of the buffer-tank the said rising branch 106 being provided with a check valve 126. In addition, the buffer-tank is equipped with an aforesaid heating means 140 such as a heating resistor or the like, connected through a remote-control transmission 124 to a level controller 107. The difference in level $h_a$ between the respective upper points of the descending vertical branch 101 and the rising vertical branch 106 of the pipe rise 123 defines the geometrical height of rise of the condensates in order to pass from the down-stream portion to the up-stream portion of the condensate return conduit 118, whereas the difference in level $h_b$ between the lower end of the up-stream portion and the upper end of the down-stream portion of this condensate return conduit 118 defines the value of the pitch-retaining rise of this condensate gravity-flow pipe, and the difference in level H between the minimum level of the condensate always maintained in the buffer-tank 105 by the level controller 107 and the upper point of the ascending branch 106 of the pipe rise arrangement 123 (at the up-stream end of the inclined stepped connecting portion 102 of the conduit 118) defines the total height of rise of the condensates, which is substantially equivalent to the over-pressure to be reduced by the thermodynamic pumping effect in the buffer-tank 105. This arrangement is characterized by an aforesaid vapour discharge conduit 141 connecting the top or vapour-phase space of the buffer-tank 105 to the vapour-phase direct-connection conduit 122 and containing the motor-actuated isolating valve 142, the servo-motor of which is connected by a remote-control transmission 143 to the monitoring member of the level controller 107. This vapour discharge conduit 141 shown in dotted lines in FIG. 12 is optional.

Figure 13:
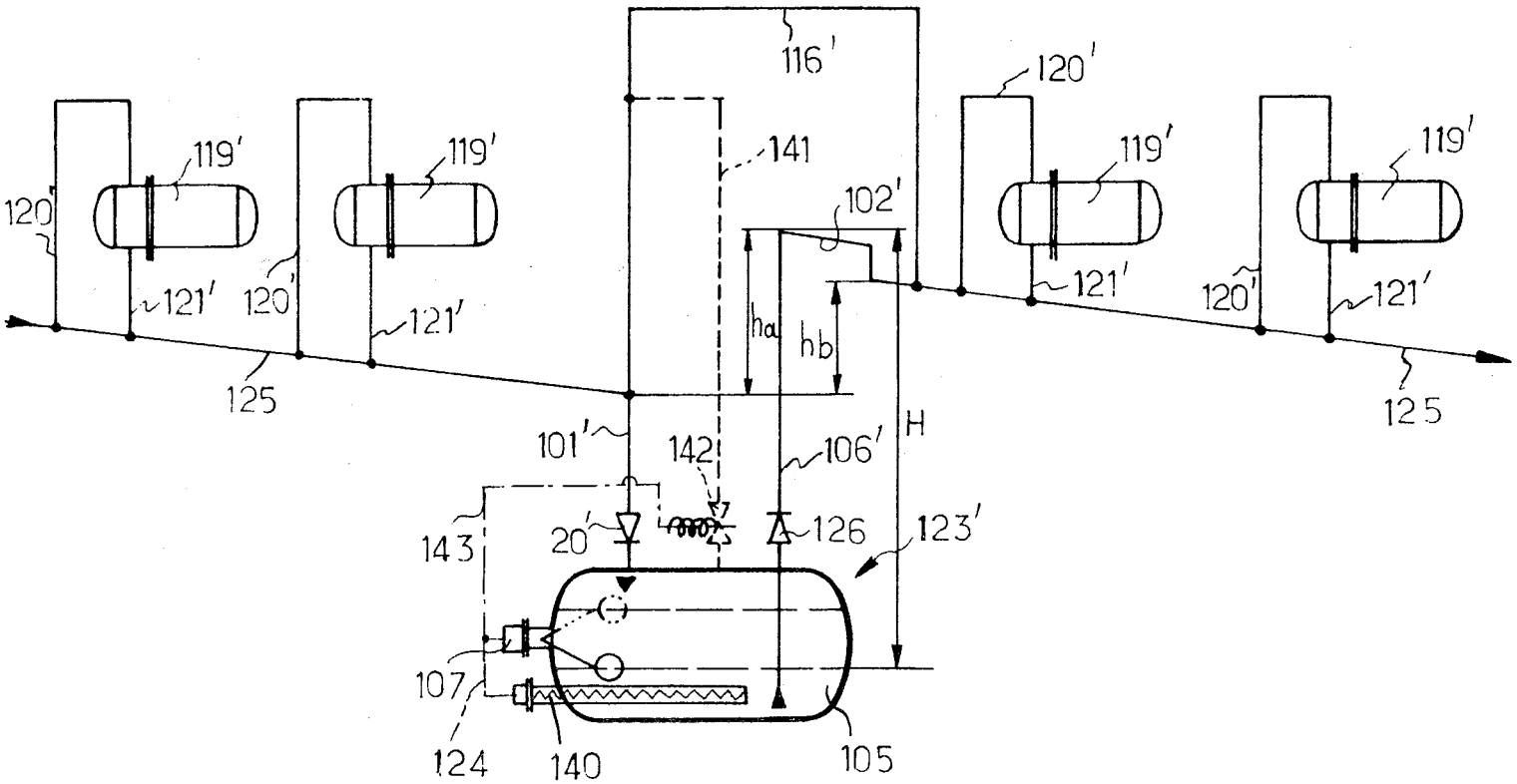
FIG. 13 is a view similar to FIG. 12, but illustrating the application of the thermodynamic pump to the case of a single-pipe network.

FIG. 13 illustrates a similar application of the same principle to a single-pipe system comprising at least one single common inclined conduit 125 for the admission of live vapour and the descending return of condensates by gravity, to which user or consumer apparatus 119' are connected in derivation through their vapour inlet pipe and condensate outlet pipe 120' and 121', respectively, the said common line 125 being provided with a pitch-retaining pipe-rise arrangement 123' including the same elements with the same definitions as in the foregoing Figure. A vapour-phase upper derivation loop 116' by-passes this pipe-rise arrangement 123' to connect the upper point of the descending vertical branch 101' of the latter to a point located down-stream of the said pipe-rise arrangement, towards the up-stream end of the downstream portion of the common conduit 125 (between the step of the inclined pipe 102' containing the rising or down-stream branch of the pipe-rise arrangement and the point of connection of the vapour inlet pipe of the first down-stream user apparatus 109'). This arrangement is characterized by an aforesaid vapour-discharge optional conduit 141 connecting the top of the buffer-tank 105 to the piping loop 116' and containing a motor-actuated stop-valve 142 remote-controlled by means of the transmission 143 by the level controller 107.

Figure 14:
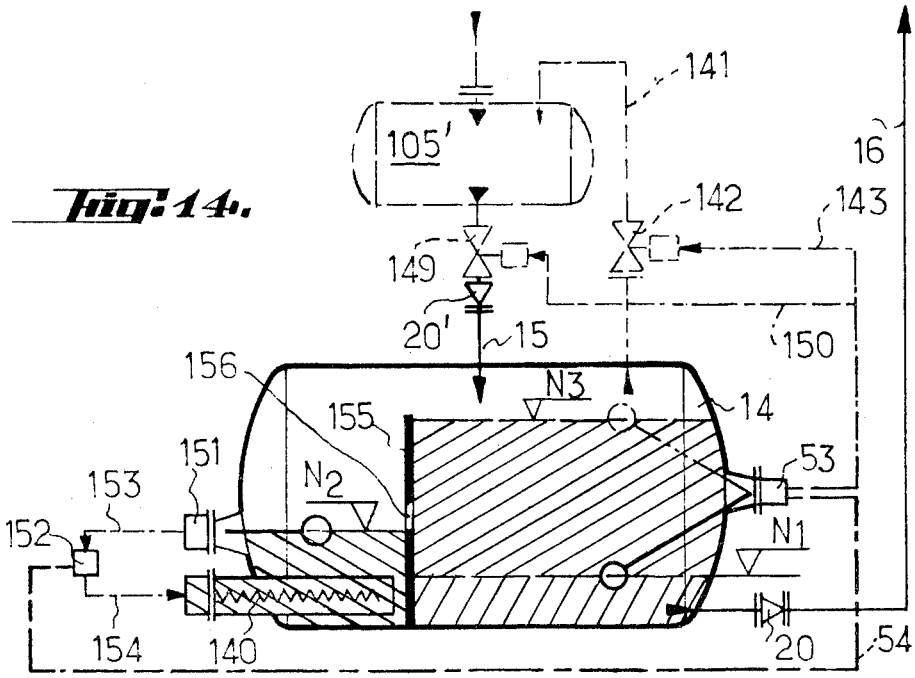
FIG. 14 illustrates a modified form of embodiment of the device of the foregoing Figure, showing the partial partitioning of the said main buffer-tank, with a heating of only the amount of liquid to be vaporized.
Figure 18:
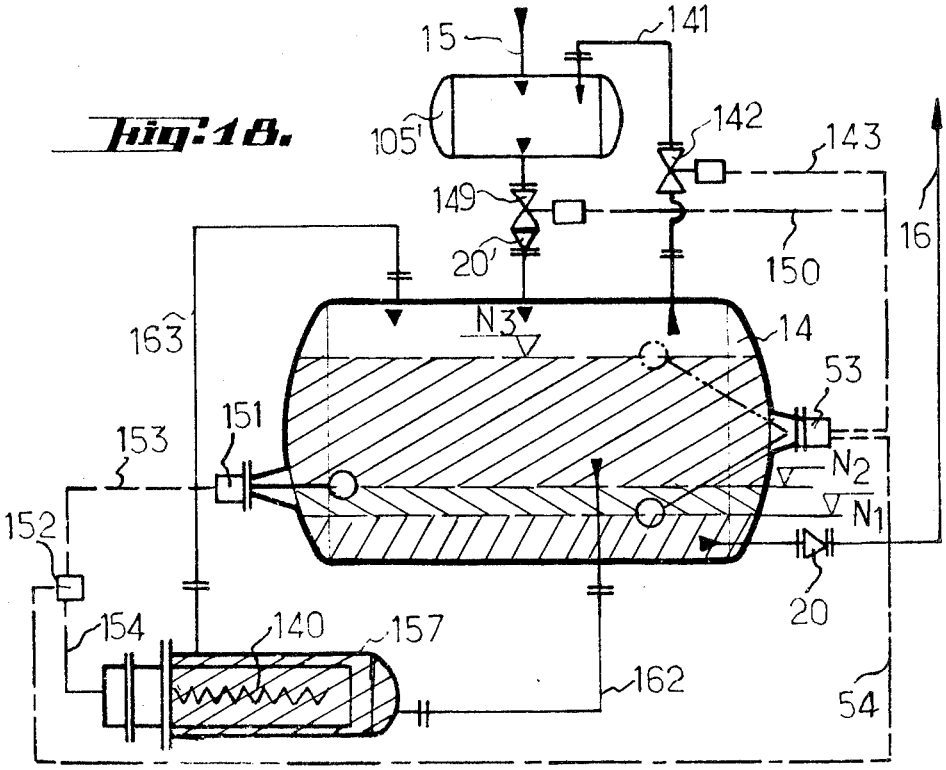
FIG. 18 shows a modification of the principle illustrated in FIGS. 14 to 17, using an external separate independent vapour generator feeding the said main buffer-tank with forcing vapour and withdrawing from the latter the necessary amount of liquid to be vaporized.

As was previously mentioned the power consumed by the thermodynamic pumping (i.e. the calorific power to be supplied by the heating means 140 such as a heating resistor or the like) is considerably higher than the power consumed by a usual mechanical delivery or forcing pump offering the required flow-rate and pressure performances. According to the invention it is possible to reduce by an important proportion (e.g. more than 60%) the calorific power to be furnished to the condensates to ensure the thermodynamic pumping by heating only the strictly necessary amount of water to be vaporized, the result being a reduction of the total cost of the energy necessary for the pressure increase to be obtained in order to force the condensates out of the buffer-tank, as well as a reduction of the time required by the thermodynamic pumping effect to accomplish an operating cycle. To this end, the method according to the invention, in order to put this idea into practice, is characterized by an early heating beginning as soon as the condensates in the aforesaid container forming a main buffer-tank reach a given intermediate filling level lower than the aforesaid maximum level. This is obtained, according to another feature of the method of the invention, by a physical separation of the volume, in particular the strictly necessary volume, of condensates to be vaporized from the volume of condensates to be delivered and by the exclusive heating of the said volume of condensates to be vaporized which is either isolated and heated within the said buffer-tank container itself or conveyed into and heated in an external adjunct container, the vapour thus produced being preferably conveyed directly into the space above the free surface plane of the liquid condensates to be delivered, and a minimum amount of condensates to be heated being retained in the buffer-tank. This method may be carried out by using any one of the arrangements illustrated in FIGS. 14 to 18, respectively. Each of the arrangements shown in FIGS. 14 to 18, respectively, may comprise an isolating valve 149 mounted towards the down-stream end of the condensate gravity-return conduit 15 opening into the main buffer-tank 14, in particular between the latter and the auxiliary buffer-tank 105', should the latter be provided. According to one feature of this arrangement, the isolating valve 149 is mounted in series with the corresponding aforesaid check valve 20' upstream of the latter and is motor-operated, its servomotor being connected through a remote-control transmission 150 to the monitoring member of the level controller 53 of the buffer-tank 14. As shown in FIGS. 14 and 18, the buffer-tank 14 is advantageously provided with an additional intermediate level controller 151 and, according to another characteristic feature of this arrangement, the respective monitoring members of the intermediate level controller 151 and of the maximum and minimum level controller 53 are connected to the switching or start-stop member of the said heating means 140 through the medium of a common pilot relay 152 by means of a respective remote-control transmission 153, 54 and 154 (connecting both level controllers to the pilot relay 152 and the latter to the heating means 140, respectively).

In the form of embodiment according to FIG. 14, the aforementioned physical separation of the condensates is obtained by means of a partial internal partition wall 155 provided in the main buffer-tank 14 and extending upwardly from the bottom of this buffer-tank up to a definite height corresponding to a maximum level $N_3$, thus subdividing the buffer-tank 14 into two unequal sections communicating with one another in the upper portion, i.e. the vapour-phase space, of the buffer-tank. This partition wall is provided with at least one interconnecting through-orifice 156 located substantially at the intermediate level $N_2$ defined by the relative position of the additional intermediate level controller 151, whereas the heating means 140 is placed in the base portion of the smaller section, the capacity of which corresponds to the necessary minimum amount of liquid to be vaporized. Each small through-orifice 156 provided in the partial partitioning wall 155 is therefore located above the heating means 140 and thus allows the said smaller section to be fed with liquid water (condensates), whereas the empty space in the upper portion of this smaller section allows for the free upward passage of the vapour and its introduction above the free surface plane of the condensates to be delivered filling the said larger section (on the right-hand side of the partition wall 155 in FIG. 14). In the example according to FIG. 14, the heating means 140 must heat the whole water volume contained in the smaller section located on the left-hand side of the wall 155. Now this volume is still usually greater than the exact amount of liquid to be converted into vapour in order that the condensates may be delivered under a higher pressure. In order to additionally reduce this volume of water to be evaporated and according to another feature of this arrangement, shown in FIGS. 15 to 18, the heating means 140 is placed in a closed enclosure 157, the capacity of which is substantially equal to the exact volume of liquid to be vaporized (to thus form an individual vapour generator) and the respectively lower and upper portions of which communicate with the lower and upper portions, respectively, of the main buffer-tank 14, at least a lower portion of the enclosure 157 being located substantially at the level of the said lower portion of the buffer-tank 14 or lower than the said level.

Figure 15:
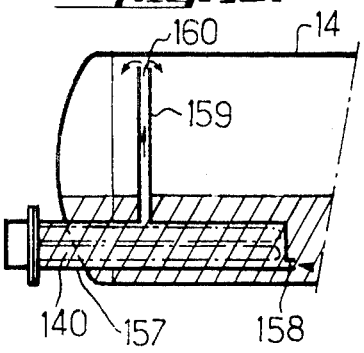
FIG. 15 is a fragmentary view, to a smaller scale, of the main buffer-tank showing another form of embodiment of the principle illustrated in FIG. 14, using a submerged internal horizontal tubular auxiliary vapour generator communicating directly, on the one hand, with the liquid phase and, on the other hand, with the vapour phase.
Figure 16:
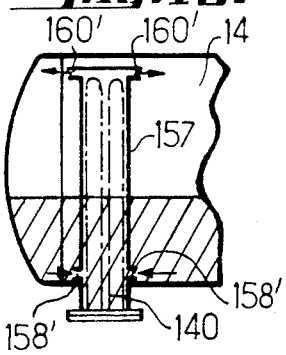
FIG. 16 is a view similar to FIG. 15, showing a modified form of embodiment with a vertical tubular vapour generator mounted through the bottom and partially emerged.
Figure 17:
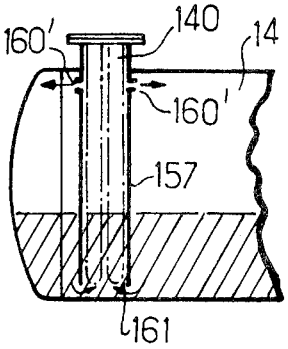
FIG. 17 is a view similar to FIG. 16, but showing the vapour generator mounted through the top of the main buffer-tank and partially immersed.

According to the forms of embodiment illustrated in FIGS. 15 to 17, the aforesaid individual vapour generator 140, 157 is located within the main buffer-tank 14, in particular in proximity to the bottom of the latter, and is provided with an elongated hollow casing, for example cylindrical in shape, forming the aforesaid enclosure 157 and placed for example horizontally as shown in FIG. 15, with at least one lower communication orifice 158 opening for example towards the free end of the said casing and a vertical open communication conduit or flue 159 extending from the upper portion of the casing 157 up into the upper, vapour-phase space of the buffer-tank 14, thus allowing this space to constantly communicate with the internal cavity of the enclosure 157. The capacity of the latter is relatively small and the orifice 158 in its lower portion allows the inflow of water, whereas the vapour produced within the enclosure 157 rises through the tubular flue 159 and escapes through its upper end orifice 160 opening in proximity to the top of the buffer-tank into the vapour-phase space of the latter. The cylindrical heating body 157 penetrates laterally into the buffer-tank 14 through the end transverse wall of the latter as seen in FIG. 15.

In the forms of embodiment of FIGS. 16 and 17, the cylindrical heating body 157 with its internal heating element 140 is placed vertically and penetrates (in a fluid-tight manner) into the buffer-tank 14 either upwardly by passing through the lower bottom of the latter as in FIG. 16 or downwardly by passing through the top of the buffer-tank 14 as in FIG. 17. In the variants of embodiment of FIGS. 16 and 17, the introduction of liquid into the heating body takes place through one or several orifices 158' passing through the lower portion of the heating body 157 (FIG. 16) or through the open lower end 161 of the heating body 157 (FIG. 17), this lower portion being sunk or immersed in the condensates, whereas the outflow of the vapour produced in the heating body 157 takes place through one or several orifices 160' passing through the wall of the upper portion of the heating body 157 into the vapour-phase space of the buffer-tank 14.

In the form of embodiment according to FIG. 18, the heating means, forming an individual or autonomous vapour generator (comprising the enclosure 157 and the heating element 140), is placed outside the main buffer-tank 14, and the lower and upper portions, respectively, of its enclosure 157 are connected through respective conduits 162, 163 to the corresponding lower and upper portions, respectively, of the buffer-tank 14. This form of embodiment, heating means is located at a lower level than the buffer-tank 14, and the conduit 162 proceeding from the lower portion of the enclosure 157 penetrates in a fluid-type manner through the base of the buffer-tank 14 and extends therein vertically up to a height corresponding substantially to the afore-mentioned intermediate level $N_2$ defined by the relative position of the intermediate level controller 151, whereas the conduit 163 connects the upper portion of the enclosure 157 to the top of the buffer-tank 14.

It should be noted that, in the forms of embodiment illustrated in FIGS. 14 and 18, the presence of the auxiliary buffer-tank 105' of the isolating valve 149 with its remote-control transmission 150, of the intermediate level controller 151 and of the pilot relay 152 with the associated remote-control transmission 153, is optional. The operation of these arrangements is as follows: when, during the filling of the main buffer-tank 14, the condensates therein reach the upper level $N_3$ (corresponding to the position in height of the upper end edge of the partition wall 155, for example in FIG. 14) the level controller 53 ensures the opening of the valves 142 and 149 as well as the operation of the heating means 140. This heating of the condensates results in a pressure rise in the vapour-phase space above the plane of the condensates in the main buffer-tank 14 and, when the final pressure is reached therein, the condensates are automatically forced out through the piping 16 running from the base of the buffer-tank 14, through the check-valve 20. It should be noted that, in the case of FIG. 18, the enclosure 157 of the heating body is filled automatically through the conduit 162 when the condensates in the buffer-tank 14 reach and rise above the intermediate level $N_2$ of the upper end orifice of this conduit. When, during the delivery, the level of the condensates lowers in the buffer-tank 14 to the lower limit level $N_1$, the level controller 53 ensures successively the opening of the valve 142 (in order to decrease the pressure in the buffer-tank 14 to the value of the pressure in the up-stream system or in the auxiliary buffer-tank 105' by discharging the vapour through the conduit 141), and then the opening of the valve 149 after the equalization of the pressures causing the delivery to stop. The condensates in the up-stream system are momentarily stored in the auxiliary buffer-tank 105' may then again enter the buffer-tank 14 by gravity through the check valve 20' (released by the pressure equalization) and fill the buffer-tank 14 until the level in the latter reaches the upper level $N_3$, thus starting a new cycle or operation.

The afore-mentioned sequence of operations takes place when there is only one level controller 53 on the main buffer-tank 14, the upper limit position $N_3$ and the lower limit position $N_1$ of the detecting member or float of which determine the beginning of the period of heating and delivery of the condensates, respectively.

According to a variant of embodiment, the adjunction of an additional intermediate level controller 151 on the main buffer-tank 14 and of the pilot relay 152 allows the heating means 140, 157 to be started as soon as the rising level of the condensates reaches the intermediate level $N_2$, thus allowing the tempo of the periodical cycles, i.e. the rate or frequency of the repetitive intermittent operations to be accelerated, by beginning to heat the condensates to be evaporated before the main buffer-tank 14 is filled up to the upper level $N_3$.

Figure 19:
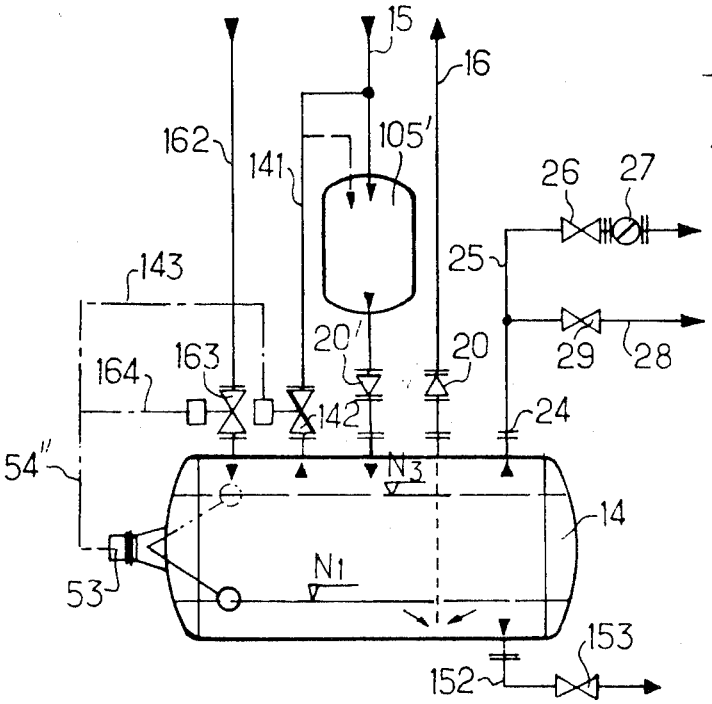
FIG. 19 is an isolated fragmentary view of a main condensate-collecting buffer-tank equipped with a system of introduction of external live force-pumping vapour.
Figure 20:
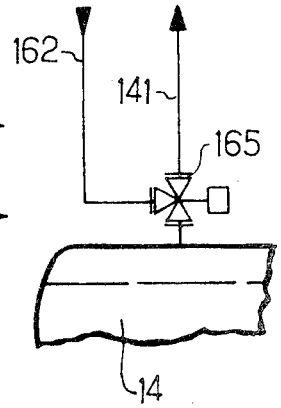
FIG. 20 is a partial view of the said main buffer-tank in which the live-vapour intake valve and the pressure release valve shown in the foregoing Figure are replaced by a three-way valve.

FIGS. 19 and 20 illustrate another way of producing a condensate delivery pressure in a main buffer-tank 14, as a variant of the aforesaid method, which is characterized by the introduction into the upper, vapour-phase space of the main buffer-tank 14 of an external live-vapour input under a higher pressure than the one existing in the up-stream system of gravity-return of the condensates or in an auxiliary buffer-tank 105' possibly provided for momentary storage of the condensates. In order to carry out this method, the upper portion of the main buffer-tank 14 is connected by at least one live-vapour admission conduit 162 to an appropriate live-vapour generating or feed source. If the pressure of the saturated vapour located above the plane of the free surface of the condensates in the closed container constituted by the partially filled main buffer-tank 14 is thus increased by introducing live vapour under a high pressure than the one initially existing in this container, it is possible, owing to this increase in pressure, to force out the condensates from the lower portion of the buffer-tank 14 through the piping 16 penetrating into the buffer-tank down to a point located in proximity to the lower bottom of the latter. In this case, there necessarily occurs a heat transfer from the high-pressure vapour introduced into the buffer-tank 14 to the vapour and the condensates at a relatively lower pressure initially contained in this buffer-tank. The live-vapour admission conduit 162 is provided with an isolating valve or the like 163 which is preferably motor-actuated and has its servo-motor connected to a remote-control transmission 164 to the level controller 53 mounted on the main buffer-tank 14. The valve 163 may also be a hand-actuated obturating member or an electromagnetically controlled valve or a valve actuated by an auxiliary fluid under pressure or a like closing member provided on the high-pressure vapour admission. In addition, the arrangement comprises the other accessories already mentioned previously, namely one or several conduits 15 for the admission by gravity of condensates under a relatively low pressure; a closing member on each condensate admission conduit, such as a non-return valve 20' or an obturating member actuated manually or controlled automatically, either remotely or not (e.g. an electromagnetic valve, a motor-operated valve, a valve controlled by an auxiliary fluid under pressure, etc.); a closing member on the condensate delivery piping 16', such as a check valve 20 or a member of one of the other types mentioned hereabove. The auxiliary buffer-tank 105' placed up-stream of the obturating member 20' provided at the inlet of the condensates into the main buffer-tank 14, is optional and is intended to temporarily contain the condensates arriving during the period when the obturating member 20' is closed. The main buffer-tank 14, instead of having a single level controller 53, may be provided with several such condensate level controllers controlling the opening and closing cycles of the various obturating members. The vapour-phase connecting piping 141 provided between the confined space located above the condensate water plane in the main buffer-tank 14 and the condensate gravity-return system 15 up-stream of the obturating member 20' may be connected to the conduit 15 or open directly into the auxiliary buffer-tank 105', if any. the purpose of this connecting piping is to ensure an immediate pressure decrease in the main buffer-tank 14 on the ending of the delivery under pressure of the condensates contained therein, but this connecting piping may also, if suitable, open into another system at a sufficiently low pressure. The closing member constituted by the isolating valve 142 on this relief piping (relief through vapour discharge) is intended to allow the vapour to be discharged only after the end of the period of condensate delivery and it may be, for example, of one of the types used for the admission of vapour under relatively high pressure. Lastly, the aforesaid arrangement is equipped with the other usual accessories such as isolating valves for cutting off the various connections, devices for by-passing the various obturating members, emptying or draining cocks and pipes, manual and automatic bleeding means for the non-condensable substances.

FIG. 20 illustrates a variant of the form of embodiment of FIG. 19, in which the valves 142 and 163 on the conduits 141 and 162, respectively, are replaced by a single three-way valve 165 fulfilling the same functions as both valves 142 and 163.

The operation of this arrangement is as follows, assuming that, initially, the main buffer-tank 14 contains no condensates, the valve 142 is open and the valve 163 is closed: the condensates proceeding by gravity through the condensate return conduit or from the auxiliary buffer-tank 105' flow into the main buffer-tank 14 through the unidirectional closing member 20' constituted, in this case, by a check valve, thus starting the filling of the buffer-tank 14. When the condensates in the latter reach the upper level $N_3$, the level controller 53 ensures simultaneously the opening of the obturating member 163 on the live-vapour admission conduit 162 and the closing of the valve 142, thus allowing live vapour under high pressure to penetrate into the upper space of the buffer-tank 14. As soon as the pressure in the latter is sufficiently high, it stops the gravitational inflow of the condensates by locking the check valve 20' in the closed position. The check valve 20' may be replaced, if suitable, by a shut-off gate remotely controlled by the level controller 53. Thereafter, since the pressure continues to increase in the confined vapour-phase space of the main buffer-tank 14, it overcomes the counter-pressure existing in the condensate delivery system 16, so that the condensates contained in the main buffer-tank 14 are delivered through the check valve 20 and the piping 16. The check valve 20 may also be replaced by a stop-gate remotely controlled by the controller 53 to be either opened or closed thereby. During the condensate delivery period, the main buffer-tank 14 empties and when the level of the condensates therein reaches the lower or minimum level $N_1$, the level controller 53 ensures the cutting-off of the live-vapour admission by causing the gate 163 to close and simultaneously opens the gate 142 on the pressure balancing conduit 141, so that the pressure in the main buffer-tank 14 decreases to the value of the pressure in the up-stream condensate-intake system 15, 105'. When this balancing of the pressures is achieved, the check valve 20' is released, so that the condensates proceeding from this up-stream condensate gravity-return system are again allowed to flow freely to enter the main buffer-tank 14 and to fill the same up the maximum level $N_3$, thus starting a new operating cycle.

There are already known, in the prior art, compressed gaseous power-fluid (compressed air or vapour) pumps of the so-called float type, which are generally used as condensate lifting devices, but not as condensate readmitting devices. In this known device, the liquid condensate to be delivered is admitted by gravity to the pump body through a check valve and progressively raises the float until the latter closes directly an escape valve and simultaneously opens an inlet valve, e.g. a live-vapour inlet valve, thus allowing the vapour to flow into the upper portion of the pump body under a higher pressure than the desired delivery head; this pressure results, on the one hand, in keeping the escape valve closed and, on the other hand, in expelling the liquid condensate by forcing the same through a check valve and, finally, in locking the condensate admission check-valve in the closed position. The pump body then empties, thus causing the float to lower, the escape valve to open automatically and the live vapour inlet valve to close simultaneously, so that the pressure in the pump decreases and releases the condensate admission check-valve, thus allowing the condensate to again enter the pump while the condensate delivery check-valve is kept closed and a new cycle starts. The vapour pump designed according to the invention and shown in FIG. 19 offers the following advantages over the known pump just described:

The known pump is applicable only to condensates whose temperature must be lower than 95° C., since the condensate flow system up-stream of the pump is periodically connected with the external atmosphere. On the contrary, the vapour pump according to the invention can be used where the temperature of the condensates is higher than 100° C. and is designed for vapour at a pressure and a temperature which are substantially constant within each system, without any separation of the phases, i.e. of the vapour condensates. Consequently, the said known pump can operate only because the condensate return systems are provided with condensed-water bleeder or drain means. Indeed, if the live vapour were allowed to reach the known pump by following the condensate admission path, the internal float of the pump would not respond and would therefore remain in its lower position, thus leaving open the vent orifice located in the upper position. All the vapour which might enter the pump through the condensate admission piping would then be allowed to escape through this orifice. On the contrary, the vapour pump according to FIG. 19 operates perfectly even when the condensate gravity-intake piping contains simultaneously vapour and condensates. Since the whole arrangement is integrated in a completely closed circuit, there can be no escape of vapour.

In the known vapour pump, all the live vapour used to deliver the condensates under pressure is lost, since it escapes to free air after accomplishing the required work. On the contrary, in the pump according to the invention, the totality of the power live vapour used for the delivery of the condensates is recovered. Furthermore, in said known pump, the condensate with the open air, the pump are necessarily made to communicate with the open air, thus inevitably causing all the live vapour losses which may pass through the bleeders, as well as all the vapour resulting from the self-vaporization due to the opening of the hot condensates to the open air, to be discharged to the atmosphere. On the contrary, in the vapour pump according to the invention, since the latter is mounted in a closed-circuit plant, therefore does not communicate with the atmosphere, no live vapour loss can occur.

The known vapour pump is applicable only to low-pressure plants in which the up-stream condensates are at the same pressure and temperature as the surrounding atmosphere. On the contrary, the new vapour pump according to the invention may be used within any range of pressures (provided power live vapour at a sufficiently high pressure is available). Moreover, the maximum condensate delivery head of the said known pump is limited to a water column about 15 m in height. On the contrary, the new pump according to the invention, is capable of providing any delivery head compatible with the available power live vapour pressure.

In the known vapour pump, the various sequences of opening and closing of the passage orifices are mechanically interlocked with the position of the internal float of the pump. On the contrary, the new pump according to the invention comprises a certain number of independent members (level controller, remote-controlled members and so forth) which may be programmed differently according to the nature of the problem to be solved.

If the condensates of the main buffer-tank 14 must be delivered to a place where the pressure is higher than that of the said power live vapour used for the pumping, it is advantageous, according to another feature of the method of the invention, to provide a combination of the introduction of the power live vapour onto the said main buffer-tank with the afore-mentioned vaporizing heating of at least part of the said condensates, in such a manner that the total vapour pressure thus produced in the said main buffer-tank be at least equal to the necessary delivery pressure. In this case, the said main buffer-tank is for example connected, by its lower portion by means of a delivery conduit, to a vapour generating boiler or to a system of lines at a higher pressure than that of the said power live vapour, and, to this end, the arrangement allowing this variant of the method to be carried out is characterized in that it comprises both the aforesaid vaporizing heating means 140 according to one of FIGS. 8 to 18 and the live vapour admission conduit 162 (according to FIG. 19 or 20) connecting the upper portion of the main buffer-tank 14 to a live vapour supply, to thus constitute a combined pumping substation.

Such a combined arrangement may advantageously be used for example in the following case: When the condensates under a pressure of for example, 2 bars must be delivered to a place where the pressure is 15 bars, and if the available live vapour is at a pressure of only 14 bars, use is then made of a pumping by means of the power live vapour at 14 bars, which is completed by a thermo-dynamic pumping effect by heating the condensates, e.g. electrically, to produce the lacking 1-bar pressure in order to obtain the necessary final delivery pressure of 15 bars.

The various foregoing forms of embodiment or parts of the latter, may of course be combined and associated with one another in different manners in closed-circuit vapour systems or networks with direct reintroduction of the condensates into the boilers, the working fluid being everywhere at a temperature and a pressure which are substantially or at least approximately constant and identically the same at all points of the said systems or networks (disregarding flow pressure losses and casual cooling) which are generally completely deprived of any vapour or condensate bleeder, drain or like phase-separating devices.

Of course, the invention is by no means limited to the forms of embodiment described and illustrated, which have been given by way of example only. In particular, it comprises all the means constituting technical equivalents to the means described as well as their combinations should the latter be carried out according to the gist of the invention and used within the scope of the following claims.

What is claimed is:

1. A closed loop system having at least one vapor producing evaporating boiler, at least one vapor utilizing condenser, and at least one condensate recovery collector, an improved automatic and continuous method of recovering and distributing condensate within such system and of introducing fresh liquid into the system, wherein said condensate and liquid is binary consisting of vapor and a liquid phase (condensates) and is at pressures and temperatures approximately constant everywhere and identically equal (disregarding the local flow-pressure losses) in the system between a point of supply of vapor to and across the vapor utilizing condenser and a point of delivery of the condensates to the said condensate collector, with recovery of at least the most part of the condensates by natural return-flow to the collector tank, the said method consisting in replenishing the boiler from two sources of make-up liquid constituted respectively, on the one hand, by a supply of external input feed-liquid and on the other hand, by the recovered condensates, and of providing a supply flow-rate which may be controlled automatically according to the instant sensed level of liquid in the collector tank within a defined range of controlled values between two limits, viz. an upper or feed shut-down limit and a lower or maximum feed flow-rate limit, and of providing introduction of the make-up liquid from the collector tank directly into the boiler by forced circulation, according to the instant sensed level of liquid in the boiler within a defined range of controlled values between two limits, viz. an upper or feed shut-down limit and a lower or maximum flow rate limit, and where the reintroduction is continuous and depends only on the actually detected physical presence of the condensates and the interlocked follow-up relationship with the sensed level of liquid in the boiler.

2. A method according to claim 1, wherein the system further has a high pressure circuit and a low pressure circuit utilizing vapor at a high pressure and vapor at a low pressure, respectively, wherein the vapor feeding the said low-pressure circuit is obtained by expanding part of the vapor feeding the said high-pressure circuit, and at least part of the condensates discharge from each circuit is recovered and accumulated at least temporarily in an individual storage collector, at least the condensates from the storage collector of the said high-pressure circuit being reintroduced directly into the said boiler according to the needs of the later for liquid, with automatic control of the rate of outflow of the condensates proceeding from the said storage collector of the said low-pressure circuit, by opening and closing an on-off type control interlocked in follow-up relationship with the detected instant amount of condensates present in the said storage collector of the said low-pressure circuit, there being also provided an automatic control of the rate of inflow of the condensates into the said storage collector of the said low-pressure circuit by opening and closing an on-off type control interlocked in follow-up relationship with a measured instant amount of condensates in the said storage collector of the said low-pressure system, in such a manner that the respective controls of the rates of inflow and outflow, respectively, are performed in mutually opposite relationship, said inflow being cut off when the said outflow is taking place, and vice versa, whereas the said method further consists in isolating the said storage collector of the low-pressure circuit from the latter by closing the on-off type control therebetween, in equalizing the respective pressures in the storage collectors of the high and low pressure circuits by providing a communication between the latter by opening the on-off type control therebetween, and in discharging by gravity the condensates from the said storage collector of the low-pressure circuit into the said storage collector of the high pressure circuit.

3. In a closed loop-system of production and distribution of condensable vapor having at least one vapor producing evaporating boiler, at least one vapor utilizing device producing liquid condensates, and at least one condensate recovery collector, the combination in such system that said liquid is binary consisting of two phases, namely viz. a gaseous phase (vapor) and a liquid phase (condensates) and of having such liquid at pressures and temperatures approximately constant everywhere and identically equal at all points between a point of supply of vapor to and across the vapor utilizing device and a point of delivery of the condensates to said condensate collector, a feed tank for the supply of make-up feed liquid and at least one supply conduit having therein a piloted power-driven feed pump connecting said feed tank to said condensate collector; at least one circuit of condensate discharge and return line connected between said condensate collector and said boiler and including at least one condensate direct-reintroduction piping having therein a main circulation impelling member for the direct reintroduction of the said condensates into the said boiler; and automatic control means for the flow-rate of direct reintroduction of the condensates into said boiler and of the supply of make-up feed liquid into the condensate collector, said control means being interlocked in follow-up relationship respectively, with the amount of vaporizable liquid remaining in the boiler and of the instant amount of available condensates in the condensate collector.

4. The closed-loop system combination according to claim 3, provided with a condensate transfer lock arrangement comprising at least a high pressure circuit and a low-pressure circuit utilizing vapor at a high pressure and a low pressure, respectively, each one provided with at least one live vapor supply line feeding said respective vapor utilizing device and with at least one condensate return line discharging the said condensates from the said devices into the upper portion of the condensate collector located at the general low point of the circuit considered, said low-pressure condensate collector being provided with a level controller for controlling the level of liquid in said condensate collector, means including a vapor expansion valve connecting the high-pressure live vapor supply line to the low-pressure live vapor supply line, piping connecting the high-pressure condensate collector to the said boiler from the bottom of the said high-pressure condensate collector, a forcing-pump maintained in the piping in order to provide a constant static head, a motor-actuated valve located also in the said piping downstream of the forcing pump in the vicinity of said boiler, the said valve being controlled automatically in interlocked follow-up relationship with the instant water level in the said boiler, said low-pressure condensate collector being placed higher than the said high-pressure condensate collector, a drain conduit connecting the bottom of the low pressure condensate collector to the high-pressure condensate collector, a motor-actuated stop valve connected in each of said low-pressure condensate return line and the said drain conduit located respectively up-stream and down-stream of the said low-pressure condensate collector, and means for operating the stop valves in opposite opening and closing sequences respectively controlled by the said level controller, whereby the sensed high level initiates draining by gravity of the low-pressure condensate collector to the high-pressure condensate collector while isolating the low-pressure condensate collector from the low-pressure circuit.

5. In a closed loop system utilizing a vaporizable-condensatable liquid and including a boiler with a liquid input and a high temperature vaporous output, a heat utilizing device for receiving the vaporous output and thereby releasing condensate, and a buffer-tank for collecting the condensate, an improved method for automatically and continuously maintaining sufficient liquid in the system, comprising the steps of maintaining a minimum level of liquid in the buffer-tank by detecting the level of liquid therein and by admitting liquid from a source outside of the system into the buffer-tank responsive to detected low liquid levels, of utilizing the buffer-tank as a source in the system of continuous liquid and of continuously withdrawing liquid therefrom and rendering the same at a higher pressure than that in the boiler, and of maintaining a minimum liquid of level in the boiler by detecting the level of liquid therein and by variably admitting to the boiler such part of said withdrawn liquid as needed responsive to detected low liquid levels and of bypassing any remaining withdrawn liquid through a fixed resistance back to the buffer-tank.

6. In a closed loop system utilizing a vaporizable-condensatable liquid and including a boiler with a liquid input and a high temperature vaporous output, a heat utilizing device for receiving the vaporous output and thereby releasing condensate, and a buffer-tank for collecting the condensate, the combination therewith of means for automatically and continuously maintaining sufficient liquid in the system, comprising first means for detecting the liquid in said buffer-tank, means for providing a source of liquid from outside of the system, means for admitting liquid from the source means to the buffer-tank responsive to the first liquid detecting means detecting low levels of liquid, means for continuously withdrawing liquid from the buffer-tank and rendering the same at a higher pressure than that in the boiler, second means for detecting liquid in the boiler, means for variably admitting to the boiler such part of said withdrawn liquid as needed responsive to the second liquid detecting means detecting low levels of liquid, and means for bypassing any remaining withdrawn liquid back to the buffer-tank.

7. A method according to claim 1, wherein the discharged condensates are collected and accumulated at least temporarily in one main single collector tank constituting one of the said make-up liquid sources, and reintroduced by mechanical inpulse with automatic control of the rate of inflow of the said make-up liquid (composed of at least one of its two constituents) into each boiler, the said automatic control being of either one of the floating on-off type and of the gradual modulating action-type interlocked in follow-up relationship with the level of liquid in the said boiler, with a continuous flow of make-up liquid furnished from the said main collector tank and part of which is diverted and recovered in the form of a diverted permanent leakage current of make-up liquid with a continuous, relatively low and selectively controllable flow-rate, the said leakage current being returned to one of the two sources, according to either one of the step of mixing with the inflow of feed liquid and of the step of returning directly to the said main condensate collector tank.

8. A method according to claim 7, wherein the said feed liquid inflow into the said main collector tank is interlocked in follow-up relationship with a predetermined minimum amount of liquid maintained in the said collector tank in order to heat the said, cold inflow of feed liquid by dispersion in this minimum residual mass of hot liquid.

9. A method according to claim 7 using at least one auxiliary storage of condensates collected by natural gravitational flow and delivered in a mechanically forced flow into the aforesaid main collector tank and wherein the said delivery of condensates takes place under a pressure approximating to the one existing in the aforesaid boilers.

10. A method according to claim 9, wherein the excess pressure of the liquid stored in the said main collector tank is discharged automatically, for example, into the said feed liquid supply.

11. A method according to claim 1, in particular for intermittent forced delivery of condensates, for any selected one of the following purposes: direct reintroduction into a vapor-producing evaporating boiler, delivery into a higher-pressure system, passing of a geometrical rise such as a pitch-retaining arrangement by the discharge flow of condensates, in the aforesaid close loop system wherein the return-flow of the condensates takes place in at least one closed collector tank forming a main buffer-tank located at a low point, the said method consisting in awaiting the obtention of a predetermined maximum level of filling of the said collector tank with liquid; in isolating from the outside the upper space of the said collector tank containing the gaseous phase by either one of the following procedures: cutting off any, at least unidirectional, fluid communication with at least the up-stream portion of the said system, stopping the up-stream inflow and preventing any return of the down-stream current of condensates into the said collector tank; and in applying, at the free surface of the contained liquid, a sufficient additional vapor pressure to allow the total available gas pressure to be substantially equivalent to the sum of the necessary net geometrical height of delivery and the down-stream flow pressure losses to be overcome.

12. A method according to claim 11, comprising providing a controlled cyclic operation with periodical repetition and automatic control interlocked in follow-up relationship with the instant amount of condensates in the aforementioned collector tank.

13. A method according to claim 11, comprising providing a collection and temporary accumulation of the condensates in at least one auxiliary buffer-tank up-stream of the said main buffer-tank during the forced delivery of the condensates from the latter.

14. A method according to claim 13, comprising providing an automatic discharge of vapor pressure from the said main buffer-tank at the end of the delivery cycle whereas the said discharge is continued until the said vapor pressure in the said main buffer-tank becomes substantially equal to the pressure of the condensates up-stream of the said main buffer-tank.

15. A method according to claim 14, wherein the said equalization of the pressure is obtained by providing a temporary controlled direct communication between either one of the following pairs of spaces: the respective upper spaces of gaseous phase confinement of the said main and auxiliary buffer-tanks, respectively; the upper space of the said main buffer-tank and either one of the up-stream inflow of condensates and of the live vapor supply flow.

16. A method according to claim 11, comprising providing a safety discharge of the excess condensates present in the said main buffer-tank, into either one of a feed tank and of a lower pressure system and automatically controlled in interlocked follow-up relationship with the admissible maximum liquid level in the said main buffer-tank, in particular in the case of at most reduced needs of the aforesaid boiler in liquid to be vaporized, said method further providing a safety discharge of vapor in case of over-pressure in the said main buffer-tank, said latter discharge being automatically controlled in interlocked follow-up relationship with the admissible maximum pressure, the said excess condensates being discharged into either one of the excess condensate discharge line and of the up-stream inflow of condensates.

17. A method according to claim 11, usable in the case of at least two pumping sub-stations mounted in parallel, and consisting in providing an automatic time-lag simultaneously interlocked in follow-up relationship with the instant amounts of condensates present in the said main buffer-tanks, respectively, of the said pumping sub-stations in order to throw out of step their respective operations for the purpose of a substantially continuous replenishment of the said boiler with liquid to be vaporized, by separately operating one of the sub-stations while the other is being filled with condensates.

18. A method according to claim 11, consisting in heating at least part of the liquid phase present in the aforesaid collector tank by means of an input of external heat in order to respectively raise its temperature and vaporize part of the said liquid in order to raise the pressure, thus creating a flow-boosting thermodynamic pumping effect producing the circulation.

19. A method according to claim 18, consisting in providing an earlier heating beginning as soon as the condensates in the said collector tank reach a given intermediate filling level lower than the said maximum level.

20. A method according to claim 18, consisting in providing a physical separation of the volume of condensates to be vaporized from the volume of condensates to be delivered and by the exclusive heating of the said volume of condensates to be vaporized, said method further comprising on the one hand either one of the following steps: isolating and heating said volume within the said collector tank itself, conveying said volume into and heating same in an external adjunct collector tank, with direct supply of produced vapor above the level of the liquid condensates to be delivered, and on the other hand the keeping of a minimum amount of condensates to be heated.

21. A method according to claim 20, consisting in the introduction, into the upper space of the said main buffer-tank, of an external input of live vapor under a higher pressure.

22. A method according to claim 21, for delivering the condensates from the said main buffer-tank to a place where the pressure is higher than that of the said live vapor, consisting in providing a combination of the introduction of the said live vapor into the said main-buffer-tank and of the said vaporizing heating of at least part of the said condensates, in such a manner that the total vapor pressure thus produced in the said main buffer-tank be at least equal to the necessary delivery pressure.

23. A device according to claim 3 wherein at least one automatic-control valve is mounted in series in the said reintroduction piping and the servo-motor of which is connected by a remote-control transmission to a liquid level controller of the said boiler; a permanent leakage conduit being connected to the said direct reintroduction piping between the said main circulation impelling member and the said automatic control valve and communicating with the said condensate collector forming a main buffer-tank wherein the said leakage conduit opens into either one of the said supply conduit after the said feed pump, and of the top of the said main buffer-tank, whereas the said common pipe is connected in parallel with several boilers by, respectively, branch conduits each of which contains an automatic control valve, the said supply conduit opening into the bottom of the said main tank, the servo-motor of the said feed pump being connected by a remote-control transmission to the level controller of the said main buffer-tank.

24. A device according to claim 23, wherein the suction pipe of the said main circulation impelling member passes through the lower bottom of the said main buffer-tank and penetrates substantially vertically into the latter up to a height corresponding to the minimum amount of liquid to be maintained in the said buffer-tank.

25. A device according to claim 23, with at least one auxiliary pumping sub-station composed of an auxiliary buffer-tank into which opens the aforesaid condensate return line and of an auxiliary pump maintained under static head by the said auxiliary buffer-tank and whose delivery conduit opens into the top of the said main buffer-tank, wherein either one of the top of the said main buffer-tank and of the said delivery conduit is connected to a safety valve, the outlet orifice of which is connected by a discharge pipe to the upper portion of the aforesaid feed tank.

26. A device according to claim 4, wherein the up-stream end of the said drain conduit penetrates into the said low-pressure buffer-tank up to the upper portion of the latter through a substantially vertical tube provided with orifices at its base.

27. A device according to claim 3, in an aforesaid close-loop system having at least one main condensate recovery collector forming a main buffer-tank provided with at least one level controller having at least two mutually opposite working limit positions, viz. a maximum limit position and a minimum limit position, and mounted in an inclined conduit for the descending return of the condensates, ending into the aforesaid boiler, said main buffer-tank being placed at either one of a general low point to form a pumping sub-station for direct reintroduction into the boiler and of a local low point at a pitch-retaining pipe rise to form a lift pumping sub-station for the passing of a geometrical rise, the respectively up-stream and down-stream portions of the said conduit being connected to the respectively upper and lower portions of the said main buffer-tank, with a check valve intercalated in the said down-stream conduit portion, said device further comprising means for producing vapor through either one of additional introduction and of local production of vapor in the upper space of the said main buffer-tank, the said means comprising a switching member connected by a remote-control transmission to the monitoring member of the said level controller, whereas a check valve is mounted in series in the said up-stream conduit portion.

28. A device according to claim 27, including an isolating valve mounted in the aforesaid up-stream conduit portion, wherein the said valve is connected in series with the said corresponding check valve, up-stream of the latter, and is motor-actuated, its servo-motor being connected by a remote-control transmission to the monitoring member of the said level controller.

29. A device according to claim 27, wherein the said main buffer-tank has its upper portion connected by at least one vapor discharge conduit to the said up-stream portion of the condensate return conduit before the said check valve through the medium of a motor-actuated stop-valve whose servo-motor is connected by a remote-control transmission to the monitoring member of the said level controller.

30. A device according to claim 29, in an aforesaid, two-pipe system of vapor production and distribution, including at least two systems of lines for, respectively, the supply of live vapor and the discharge of condensates, with at least one pipe-rise arrangement in the said condensate return conduit, provided with a said main buffer-tank and at least one vapor-phase direct-connection conduit between the said two systems of lines, interconnecting the upper point of the descending branch of the said pipe-rise arrangement to a live vapor supply conduit, wherein the said vapor discharge conduit is connected to the said direct connection conduit.

31. A device according to claim 29, in an aforesaid, one-pipe systemof vapor production and distribution, including at least one single live vapor supply and condensate return conduit with at least one pipe-rise provided with a said main buffer-tank and an upper vapor-phase by-pass loop by-passing the said pipe-rise arrangement and connecting the upper point of the descending branch of the latter to a point located down-stream of the said pipe-rise arrangement, wherein the said vapor discharge conduit is connected to the said loop.

32. A device according to claim 29, comprising at least one auxiliary buffer-tank intercalated in series in the up-stream portion of the said condensate return conduit before the said check valve and after an additional up-stream check valve, whereas the said vapor discharge conduit opens into the upper portion of the said auxiliary buffer-tank, the capacity of the latter being substantially equal to the volume of condensates defined between the limit level positions namely the maximum limit level position and the minimum limit level position, of the detecting member of the said level controller in the said main buffer-tank, which respectively switch on and switch off the said heating means, therefore equal to the volume variation between two successive fillings or emptyings.

33. A device according to claim 27, in an aforesaid closed-loop system of production and distribution of condensable vapor including at least two pumping sub-stations for reintroduction of condensates, mounted in parallel, wherein the monitoring member of the said level controller of each main buffer-tank is connected by an individual remote-control transmission to a common regulator and time-lag member.

34. A device according to claim 27, in an aforesaid closed-loop system of production and distribution of condensable vapor, each said main buffer-tank of which is provided with an upper-level controller and has its lower portion connected to either one of a feed tank and of a lower-pressure system by at least one condensate discharge conduit containing a check valve and a motor-actuated stop-valve whose servo-motor is connected by a remote-control transmission to the monitoring member of the said upper-level controller, wherein the upper portion of the said main buffer-tank is connected to either one of the said condensate discharge conduit and of the up-stream portion of the said condensate return conduit by a safety relief conduit containing a safety valve.

35. A device according to claim 27, comprising heating means such as a heating resistor in heat exchange and transmission connection with at least part of the lower volume of condensates contained in the said main buffer-tank.

36. A device according to claim 35, including a said main buffer-tank provided with an additional intermediate level controller, wherein the respective monitoring members of the said intermediate level controller and of the said maximum and minimum level controller are connected to a member for the switching of the said heating means through the medium of a common pilot relay.

37. A device according to claim 35 wherein the said main buffer-tank comprises a substantially vertical, partial internal partition wall extending upwardly from the lower bottom of the said main buffer-tank up to a predetermined height corresponding to a maximum level, thus subdividing the said main buffer-tank into two unequal sections communicating with one another in the upper portion, i.e. in the vapor-phase space, of the said main buffer-tank, the said partition wall being provided with at least one interconnecting through-orifice located at the said intermediate level, whereas the said heating means is placed in the smaller section towards the base of the latter, the useful capacity of which corresponds to the necessary minimum amount of liquid to be vaporized.

38. A device according to claim 35, wherein the said heating means is placed in a closed enclosure, the capacity of which is substantially equal to the volume of liquid to be vaporized in order to form a vapor generator and the respectively lower and upper portions of which communicate respectively with the lower and upper portions of the said main buffer-tank, at least an upper portion of the said enclosure being located substantially at most at the level of the said lower portion of the said main buffer-tank.

39. A device according to claim 38, wherein the said heating means is located outside the said buffer-tank and the lower and upper portions of its said enclosure are connected by respective conduits to the corresponding portions of the said main buffer-tank in the base of which the said conduit, proceeding from the lower portion of the said enclosure, penetrates and opens substantially vertically up to a height corresponding substantially to the said intermediate level.

40. A device according to claim 38, including heating means located outside the said main buffer-tank and comprising an elongated hollow body, for example cylindrically tubular in shape, forming the aforesaid enclosure and placed either horizontally with at least one lower communication orifice opening towards its free end and an open vertical communication conduit extending from its upper portion into the upper space of the said main buffer-tank, or vertically with communication orifices opening respectively towards its base and towards its top.

41. A device according to claim 35, wherein at least one live vapor supply conduit opens into the upper portion of the said main buffer-tank and is provided with a motor-actuated isolating valve, the servo-motor of which is connected by a remote-control transmission to the monitoring member of the aforesaid level controller of the said main buffer-tank.

42. A device according to claim 41 wherein a delivery conduit connects the lower portion of said main buffer-tank to either one of the aforesaid boiler and a system of lines wherein the pressure is higher than that of the said live vapor, said main buffer-tank being provided with both the aforesaid vaporizing heating means and live vapor supply conduit connecting the upper portion of the said main buffer-tank to a live vapor supply source whereby to constitute a combined pumping sub-station.

* * * * *